US008590180B2

(12) United States Patent
Hren et al.

(10) Patent No.: US 8,590,180 B2
(45) **Date of Patent: *Nov. 26, 2013**

(54) DIPPER DOOR LATCH WITH LOCKING MECHANISM

(75) Inventors: William J. Hren, Wauwatosa, WI (US); Joseph J. Colwell, Hubertus, WI (US); Jeffrey S. Schwake, Milwaukee, WI (US); Bruce P. Kearsley, Minden, NV (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 281 days.

This patent is subject to a terminal disclaimer.

(21) Appl. No.: 12/986,933

(22) Filed: Jan. 7, 2011

(65) Prior Publication Data

US 2011/0146114 A1 Jun. 23, 2011

Related U.S. Application Data

(63) Continuation-in-part of application No. 12/684,883, filed on Jan. 8, 2010, now Pat. No. 8,136,272, which is a continuation-in-part of application No. 11/608,307, filed on Dec. 8, 2006, now abandoned, which is a continuation-in-part of application No. 11/457,141, filed on Jul. 12, 2006, now abandoned.

(60) Provisional application No. 60/698,797, filed on Jul. 13, 2005.

(51) Int. Cl.
*E02F 3/30* (2006.01)

(52) U.S. Cl.
USPC ..... 37/445

(58) Field of Classification Search
USPC ..... 37/444, 445, 443, 398, 379, 442; 414/718–726; 292/24, 95, 301, 216
See application file for complete search history.

(56) References Cited

U.S. PATENT DOCUMENTS

| | | | |
|---|---|---|---|
| 2,544,682 | A | 3/1951 | Hilgeman |
| 3,504,406 | A | 4/1970 | Schott |
| 3,805,528 | A | 4/1974 | Huebscher |
| 4,142,751 | A | 3/1979 | Varda |
| 4,254,974 | A | 3/1981 | Rolke et al. |
| 4,690,232 | A | 9/1987 | Schulz |
| 5,288,037 | A | 2/1994 | Derrien |

(Continued)

OTHER PUBLICATIONS

International Search Report and Written Opinion for Application No. PCT/US2011/020572 dated Sep. 29, 2011 (8 pages).

(Continued)

*Primary Examiner* — Robert Pezzuto
(74) *Attorney, Agent, or Firm* — Michael Best & Friedrich LLP

(57) ABSTRACT

A dipper including a dipper door and an impact actuated jaw having a "C" shape defining a lip and a chin. The jaw is rotatably mounted on the dipper door for rotation between a door-opened position and a door-closed position and positioned so that when the jaw is in the door-opened position, the jaw chin can be impacted by the dipper body when the door pivots to the door-closed position. The dipper also includes a hold open mechanism for releasably holding the door latch in the latch open position when the latch is in the open position, and a locking mechanism for releasably locking the latch when the latch is in the door-closed position. The locking mechanism includes one bar pivotally attached to the door, and another bar pivotally connected to and extending between each of the one bar and the latch.

45 Claims, 23 Drawing Sheets

(56) References Cited

U.S. PATENT DOCUMENTS

| | | | |
|---|---|---|---|
| 5,735,557 | A | 4/1998 | Harvey |
| 5,815,958 | A | 10/1998 | Olds et al. |
| 6,168,113 | B1 | 1/2001 | Hann et al. |
| 6,467,202 | B1 | 10/2002 | Brown, Jr. |
| 6,591,521 | B2 | 7/2003 | Brown |
| 2006/0249971 | A1 | 11/2006 | Ichinose |
| 2007/0107269 | A1 | 5/2007 | Hren |

OTHER PUBLICATIONS

Non-Final Office Action, U.S. Appl. No. 11/608,037, mailed Sep. 4, 2008.

Final Office Action, U.S. Appl. No. 11/608,037, mailed Jun. 10, 2009.

Advisory Action, U.S. Appl. No. 11/608,037, mailed Dec. 10, 2009.

DIPPER DOOR LATCH WITH LOCKING MECHANISM

CROSS REFERENCE TO RELATED APPLICATIONS

This application is a continuation-in-part of application Ser. No. 12/684,883, filed on Jan. 8, 2010, which is a continuation-in-part of application Ser. No. 11/608,307, filed on Dec. 7, 2006, which is a continuation-in-part of application Ser. No. 11/457,141, filed Jul. 12, 2006, which claims the benefit of U.S. Provisional Application No. 60/698,797 filed Jul. 13, 2005, the entire contents of which are incorporated herein by reference.

TECHNICAL FIELD

The present invention relates to power shovels and, more particularly, to power shovels having a dipper adapted for excavating earthen material. Specifically, the present invention relates to latches for dipper doors.

BACKGROUND OF THE INVENTION

Large electric mining rope shovels utilize a digging attachment consisting of a stationary boom with a combination handle/dipper structure which mounts on the boom and actively crowds and hoists into a bank in order to dig with and fill the dipper. The dipper is rigidly connected to the handle. After digging through a bank face and filling with material, the dipper is lifted and the upper portion of the shovel is rotated relative to the lower portion of the shovel so that the dipper is positioned above a waiting dump truck. The operator then activates a tripping mechanism that opens a dipper door latch on the bottom of the dipper and allows a door to swing down and open. The contents of the dipper are then dumped into the truck bed.

The heavy dipper door is pivotally mounted on a lower end of the dipper. The conventional mechanical latch mechanism secures the door in its closed position and, when released, allows the door to open under the force of gravity. The conventional latch mechanisms, as shown in FIGS. 2 and 3, typically include a trip wire 1 or cable assembly which has one end adapted for control by a power shovel operator and another end connected to a moveable latch lever 2 which is generally located on the dipper door 3. The latch lever is typically coupled to a slidable rod or latch bar 4 that is selectively engaged in a latch keeper opening 5 (see FIG. 3) in a front wall 6 of the dipper body of the dipper. The dipper door 3 is held closed when the latch bar 4 is within the latch keeper opening 5. The dipper door is caused to open by tripping the trip cable 1 which moves the latch lever 2 which causes the latch bar 4 to slide away from the latch keeper opening 5 and disengage the latch keeper opening 5, whereby the dipper door 3 will open under its own weight plus the weight of any material contained within the dipper body. The latch lever 2 provides significant mechanical leverage to slide and pull the latch bar 4, which is under very high load.

Normally, the door is thereafter closed by swinging the dipper in such a direction so as to cause the dipper door to move by inertia towards its closed position until the latch bar reengages the latch keeper. More particularly, the latch bar is forced away from the dipper front wall by contacting the latch keeper wall with a sloping surface that causes the latch bar to push up, and then the latch bar drops into the slot by gravity, locking the door.

This is a simple device including mainly two bars pulling on each other with dry, sliding friction contact that has worked well for many years; however, with the increase in dipper size over the past few years, its reliability has become compromised because dry sliding friction levels have increased under higher contact loads making behavior less predictable.

SUMMARY OF THE INVENTION

There are maintenance problems with this system, especially when it is used with 100-ton or larger payload dippers. Latch bars and related operating equipment are a significant part of dipper maintenance cost.

The maintenance problems include broken pull chains and clevis. The pull chain is the chain that connects a tugger rope to the latch bar lever. The trip ropes have to be replaced constantly as they become frayed and strands break. The snatch block (sheave) and bracket of the trip mechanism break or have to be replaced on a regular basis. The tugger motor, gearing and drum take a continuous beating causing repeated failures. And lastly, the latch bar has to have shimming added, and this is a constant ongoing maintenance issue that in the long run becomes labor intensive and costly.

The amount of tension required to trip or move a latch bar on a fully loaded 120-ton payload dipper nearly exceeds the mechanical ability of this system. Larger motors are usually the solution, but the net result is a very high cost maintenance area.

There are also operational problems with the existing latch system that adversely affect shovel production and safety. The dry, sliding friction that the latch lever must overcome for successful unlatching is unpredictable. On one extreme, the friction forces are so great that the shovel operator must rest the loaded dipper on the truck pile to relieve the load on the dipper door before the latch bar can be pulled out of engagement. This adversely affects production as it requires extra time to complete a dig cycle. On the other extreme, exposure to water, mud, or manual lubrication of the existing sliding latch reduces the friction forces to such an extent that the tripping effort becomes very sensitive to inadvertent trip rope line pulls. As a result, "false" trips can occur, which causes the dipper door to open at times the operator does not want it to. This is dangerous because the dipper opens before it is fully swung over the truck, potentially dropping its entire payload on the surrounding area. This is also inconvenient and nonproductive as the operator must then refill the dipper and complete a new dig cycle. The current invention provides a dipper door latch mechanism that consistently unlatches the door without requiring the operator to relieve the material load on the door by resting the door on the pile in the truck.

Many times the shovel operator will signal the dipper to trip before he is completely swung over the truck in anticipation that by the time the dipper is over the truck the delayed reaction of the existing sliding latch bar will have opened. An open dipper helps the operator stop swinging because the swing inertia is suddenly reduced by the loss of dipper payload. However, if the dipper does not open as expected, the swing inertia remains so high that it is difficult for the operator to stop swinging and the fully loaded dipper eventually stops over the truck cab canopy before finally opening. In some instances, the fully loaded dipper doesn't open until after the dipper has swung even further in front of the truck operator's cab. This is very dangerous because it exposes the truck operator to risk of serious harm. The current invention provides a dipper door latch mechanism that unlatches at the moment desired by the operator.

Yet another operational problem with the existing sliding latch bar system occurs during heeling, which is the practice of pushing the heel of the dipper into the bank rather than the dipper teeth during the dig cycle. In the existing dipper, heeling causes the material to push the existing sliding latch bar out of engagement, resulting in the door opening prematurely. This premature opening is another instance of lost production, since the dipper must be refilled from the beginning of the dig cycle. The current invention provides a dipper door latch mechanism that does not inadvertently unlatch while digging and heeling in the bank.

Another problem with conventional mechanical latch closure mechanisms is the tendency for such mechanisms to quickly wear out and require replacement in only a short period of time. Each time the slidable latch bar engages the latch keeper or the like, the tip of the slidable latch bar naturally wears down. In many conventional latch mechanisms, the slidable latch bar is only moved about a half inch to about an inch in order to allow the dipper door to open. Thus, only a very small portion, i.e., the tip, of the slidable latch bar comes into contact with the latch keeper. Since the latch bar is under very high load and the contact area is very small, the tip experiences very high contact forces that cause an accelerated rate of wear. As the tip of the slidable latch bar wears down over time, it becomes possible for the dipper door to prematurely open before the power shovel operator is ready for the dipper door to open. This, as can be appreciated by those skilled in the art, can create a hazardous and unsafe condition if the power shovel is not properly maintained.

To account for this wear, the latch bar length of engagement with the latch keeper must be frequently adjusted by adding or removing shims to the latch lever pivot mechanism 6 (see FIG. 2). This requires the lifting of the heavy latch lever and latch bar to insert and remove the shims, usually with the assistance of a crane or forklift. Thus, conventional latch closure mechanisms exhibit operational shortcomings that must be addressed with more frequent, hazardous, and costly maintenance activities.

Examples of other past dipper latch approaches include Hilgeman U.S. Pat. No. 2,544,682 that illustrates a pivoting latch with a primary locking mechanism and a secondary latch, and Brown Jr. U.S. Pat. No. 6,467,202 that illustrates a dipper door pivoted and held by a linkage mechanism.

This invention provides a dipper including a dipper door and an impact-actuated jaw having a "C" shape defining a lip and a chin. The jaw is rotatably mounted on the dipper door for rotation between a door-opened position and a door-closed position and positioned so that when the jaw is in the door-opened position, the jaw chin can be impacted by the dipper body when the door pivots to the door-closed position. The dipper also includes a hold open mechanism for releasably holding the door latch in the latch open position when the latch is in the open position, and a locking mechanism for releasably locking the latch when the latch is in the door-closed position.

In one embodiment, the locking mechanism includes one bar pivotally attached to the door, and another bar pivotally connected to and extending between each of the one bar and the latch.

The latch mechanism eliminates almost all dry sliding contact surfaces by replacing translational sliding motion with rotational motions, and replaces the dry sliding latch bar approach with a new rotational door latch where there are no members that see high loads and dry sliding friction at the same time. Dry sliding friction is replaced with greatly decreased lubricated rotational friction. Members rotate relative to each other and the dipper but the rotation does not take place while undergoing high loads. This reduces the extremely high stresses present in conventional latch mechanisms to a magnitude that requires significantly less force to actuate.

Other features and advantages of the invention will become apparent to those skilled in the art upon review of the following detailed description, claims and drawings in which like numerals are used to designate like features.

DETAILED DESCRIPTION OF THE PREFERRED EMBODIMENTS

Figure 1:
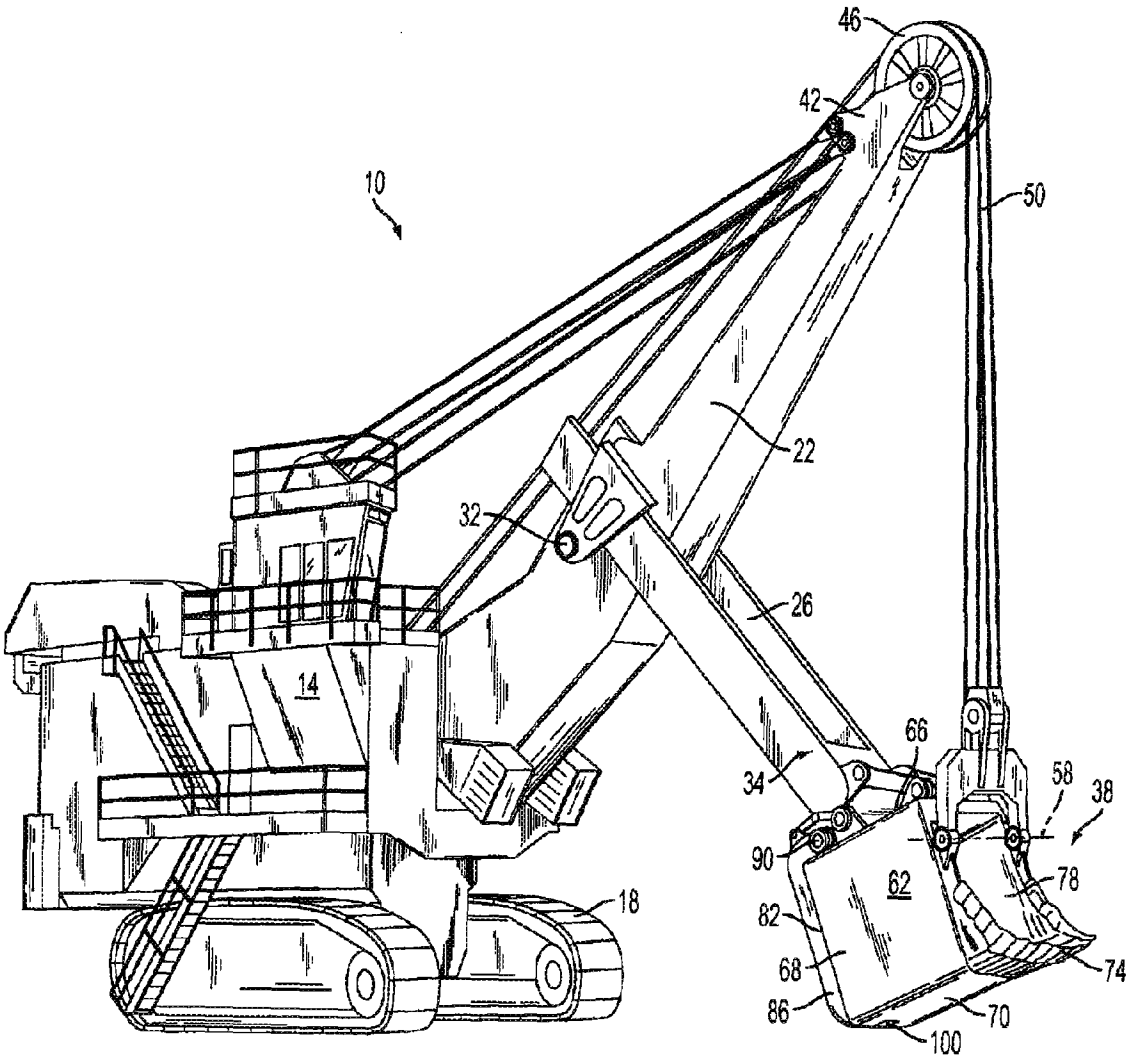
FIG. 1 is a side elevational view of a power shovel embodying the present invention.
Figure 2:
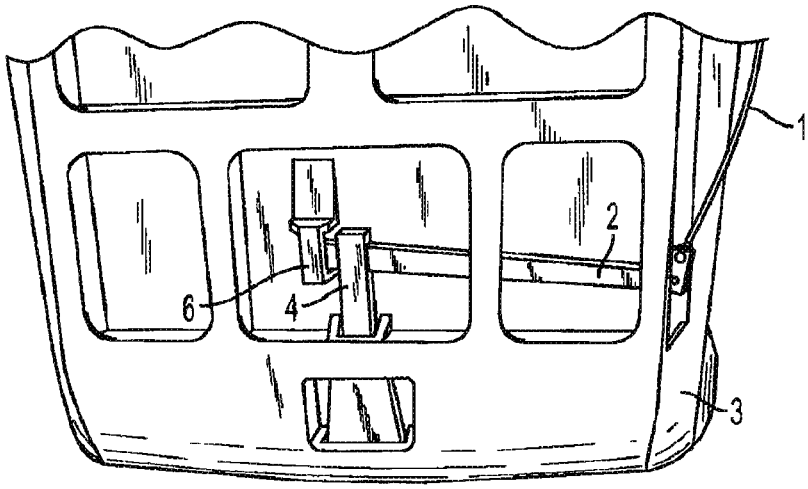
FIG. 2 PRIOR ART
FIG. 2 is a bottom view of a prior art dipper with a latch assembly to open and close a dipper door of a dipper.
Figure 3:
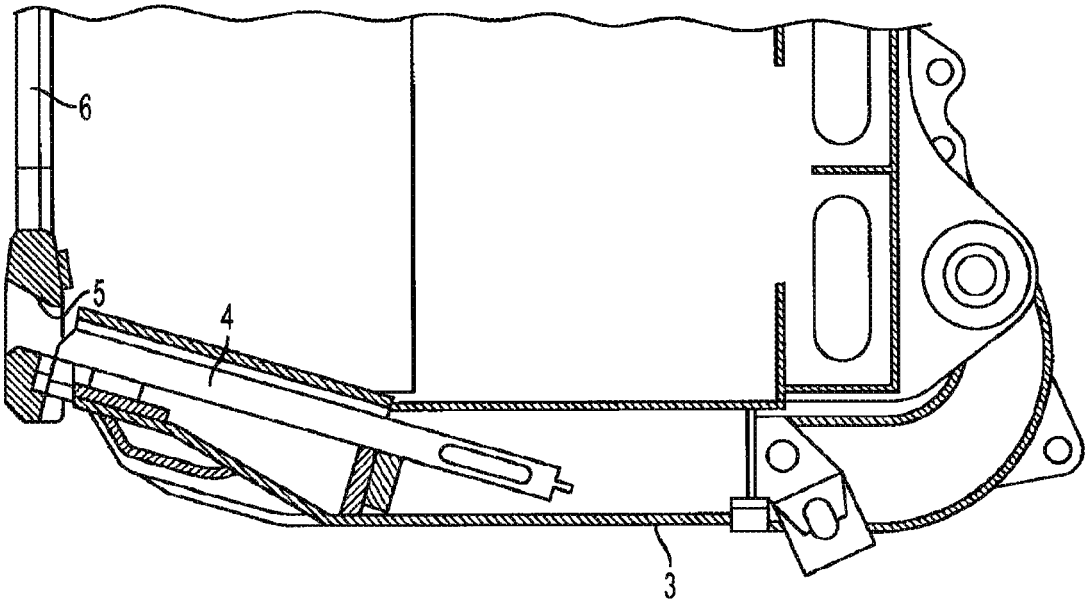
FIG. 3 PRIOR ART
FIG. 3 is a side cross sectional view of the prior art latch assembly shown in FIG. 2, illustrating how the prior art latch slides into the latch keeper.

Before the embodiments of the invention are explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein are for the purpose of description and should not be regarded as limiting. The use of "including" and "comprising" and variations thereof herein is meant to encompass the items listed thereafter and equivalents thereof as well as additional items and equivalents thereof. The use of "consisting of" and variations thereof herein is meant to encompass only the items listed thereafter and the equivalents thereof.

Illustrated in FIG. 1 is a power shovel 10 embodying the present invention. It should be understood that the present invention is capable of use in other power shovels known in the art and power shovel 10 is only provided as an example of one such power shovel. The power shovel 10 comprises a frame 14 supported for movement over the ground. Specifically, frame 14 is a revolvable upper frame mounted on a mobile base such as crawler tracks 18. A fixed boom 22 extends upwardly and outwardly from the frame 14. A dipper handle 26 is mounted on the boom 22 for movement about a rack and pinion or crowd drive mechanism (not shown) for pivotal movement relative to the boom 22 about a generally horizontal dipper handle axis 32, and for translational (non-pivotable) movement relative to the boom 22. The dipper handle 26 has a forward end 34. A dipper 38 is mounted on the forward end 34 of the dipper handle 26 in a conventional manner. An outer end 42 of the boom 22 has thereon a sheave 46, and a hoist cable or rope 50 extends over the sheave 46 from a winch drum (not shown) mounted on the frame 14 and is connected to the dipper 38 for pivotal movement relative thereto about a horizontal pivot axis 58.

The dipper 38 is generally of a box shape having a body 62 which includes a back wall 66, opposite side walls 68 extending forwardly from and substantially perpendicular to the back wall 66, and a front wall 70 which is generally parallel to the back wall 66. In other embodiments (not shown), other dipper body shapes can be used. Digging teeth 74 extend outwardly from an upper end of the front wall 70. The main body or dipper body 62 defines a material receiving opening 78 and a material discharging opening 82. The dipper 38 further includes a dipper door 86 pivotally connected to the back wall 66 adjacent the lower end thereof about a dipper door axis 90. The dipper door 86 is movable between opened and closed positions, as will be further described below. The back wall 66 of the dipper 38 is connected to the forward end 34 of the dipper handle 26. The back wall 66 (and thus the dipper 38) is rigidly connected to the dipper handle 26.

Figure 6:
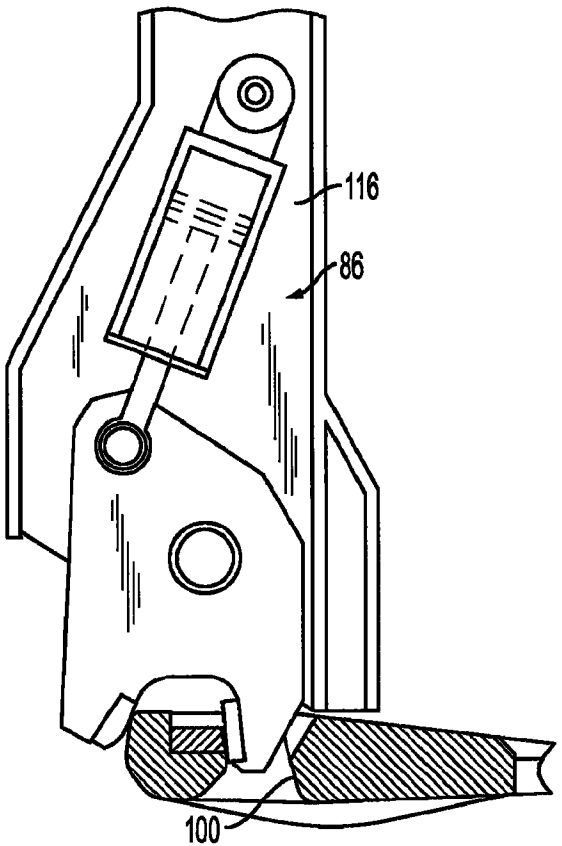
FIG. 6 is a partial cross sectional view of the latch assembly and latch keeper of this invention with the dipper door closing.
Figure 5:
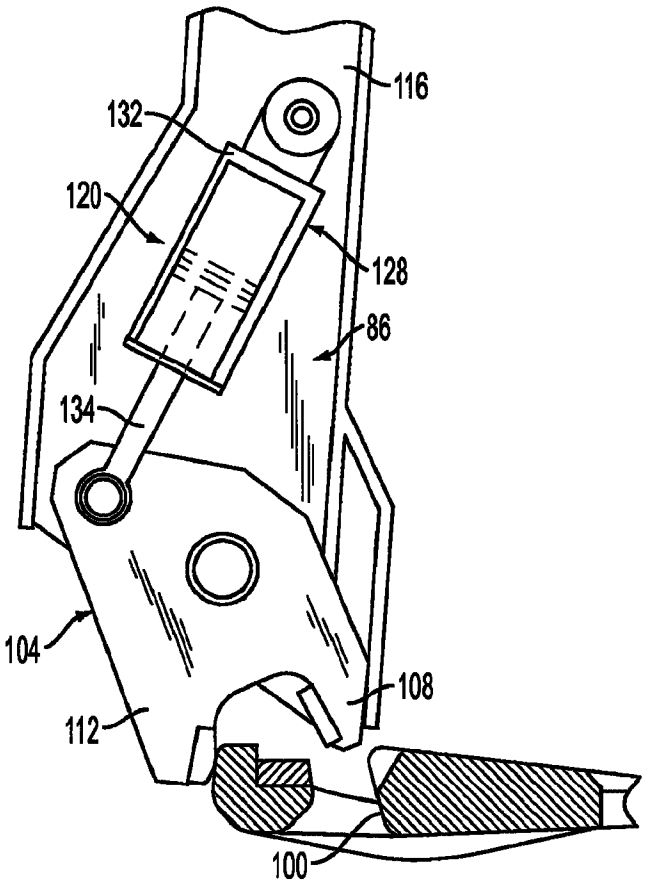
FIG. 5 is a partial cross sectional view of the latch assembly and latch keeper of this invention with the dipper door opening.

As further explained below, FIGS. 1, 5 and 6 illustrate how the dipper body 62 also has a latch receiving opening 100 adjacent one end of the discharging opening 82.

Figure 8:
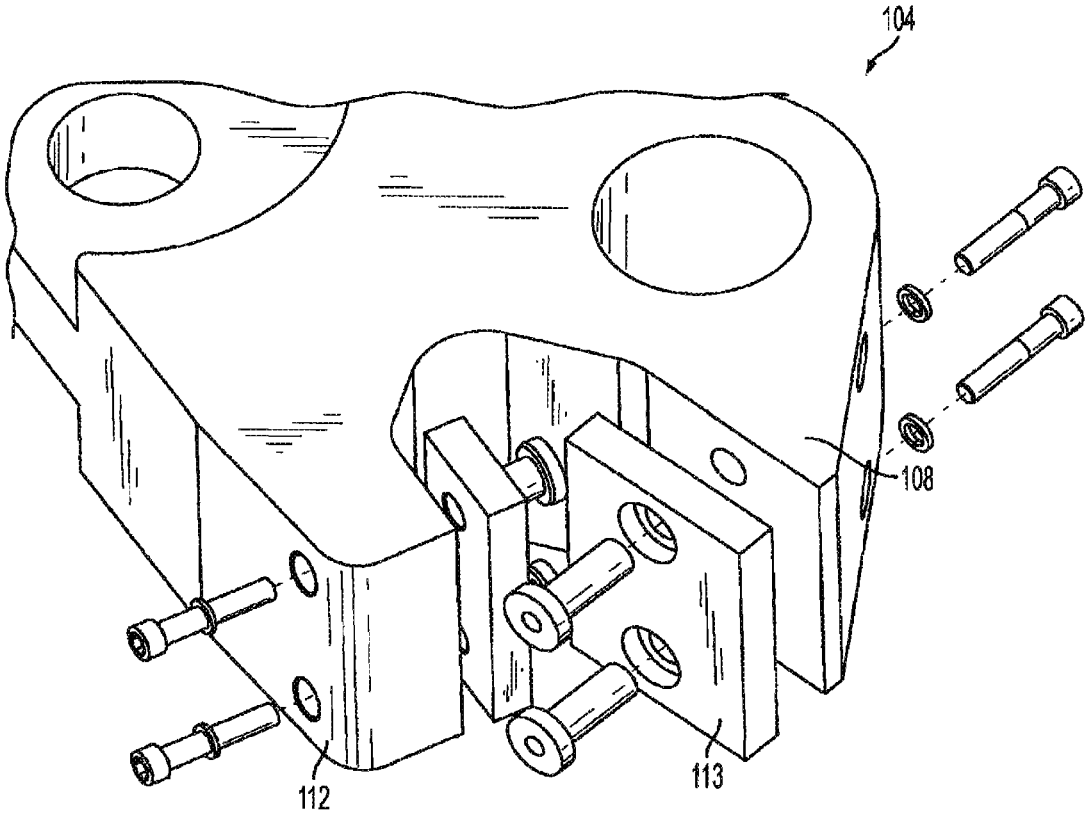
FIG. 8 is a partial exploded perspective view of the jaw of the latch assembly of this invention.

In order to keep the dipper door 86 in its closed position until it is desired to open the door 86 to drop the dipper's contents, the dipper 38 includes an impact actuated latch 104 in the form of a jaw having a "C" shape, as shown in FIGS. 4, 5, 6 and 8, thus defining a lip 108 and a chin 112. Each of the jaw lip 108 and jaw chin 112 can incorporate a removable wear plate 113, as shown in FIG. 8. The latch jaw 104 is pivotally, and more particularly, rotatably mounted on the dipper door 86 for rotation between a door-opened position (FIG. 5) and a door-closed position (FIG. 6). Further, the latch jaw 104 is positioned so that when the latch jaw 104 is in the door-opened position, the jaw chin 112 can be impacted by the dipper body 62 when the door 86 pivots to the door-closed position, and so that impact by the dipper body 62 on the jaw chin 112 rotates the latch jaw 104 into the door-closed position where the jaw lip 108 is in the latch opening 100 and prevents opening of the door 86. In other words, the jaw lip 108 is out of the way of the dipper body 62 when the latch jaw 104 is in a door-opened position, as shown in FIG. 5.

Figure 4:
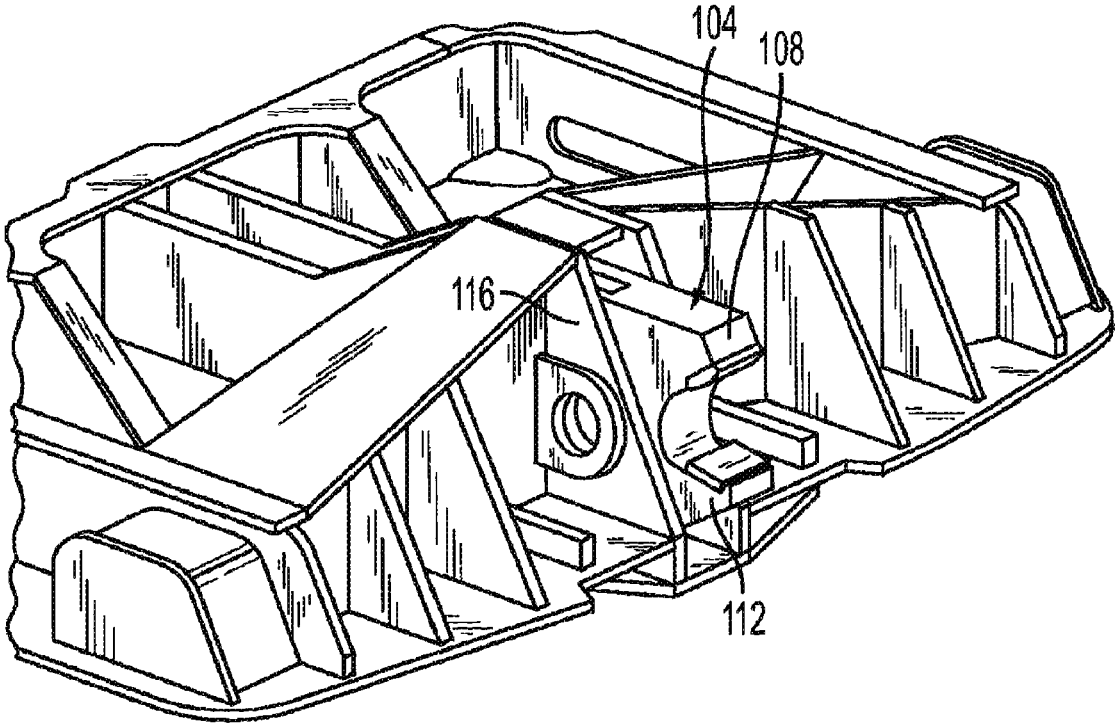
FIG. 4 is a perspective view of part of the bottom of the dipper door and the latch assembly of this invention.

More particularly, as shown in FIG. 4, the dipper door 86 includes spaced apart structural support ribs 116, and the latch jaw 104 is rotatably mounted between two of the support ribs 116. In other less preferred embodiment, a simple bar latch (not shown) can be used that rotates into and out of the latch receiving opening 100.

The dipper 38 further includes a hold open mechanism 120 for releasably holding the latch jaw 104 in the door-opened position when the latch jaw 104 is in the open position, and a locking mechanism 124 for releasably locking the latch jaw 104 when the latch jaw 104 is in the door-closed position. When the locking mechanism 124 is released, the latch jaw 104 rotates open as a result of the weight of the door 86 and the material pushing against the dipper door 86.

First Embodiment

Figure 7:
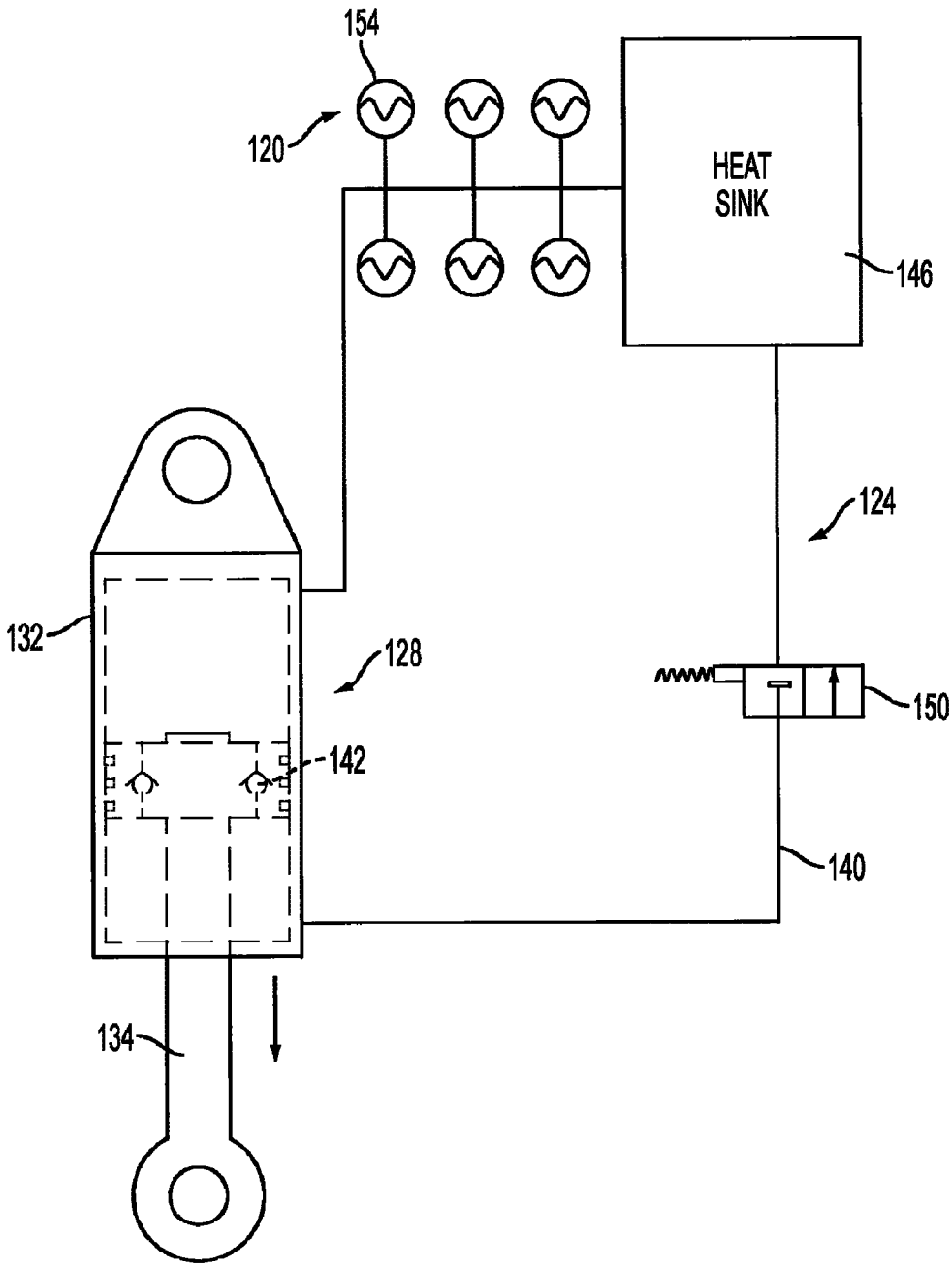
FIG. 7 is a schematic illustration of the hydraulic circuit of this invention.

In one embodiment, as illustrated in FIGS. 5, 6 and 7, the hold open mechanism 120 and locking mechanism 124 is a hydraulic cylinder assembly 128 pivotally attached to and extended between the dipper door 86 and the latch jaw 104. More particularly, as illustrated in FIGS. 5 and 6, the hydraulic cylinder assembly 128 is pivotally attached at one end between two of the support ribs 116.

The hydraulic assembly 128 is provided with a hydraulic cylinder 132 and a piston 134 that is movable within the hydraulic cylinder 132. The piston 134 divides the hydraulic cylinder 132 into a first chamber and a second chamber wherein the volumes of the chambers change as the piston 134 moves back and forth within the hydraulic cylinder 132. Either the hydraulic cylinder 132 or the piston 134 can be connected to the latch and the other connected to the dipper door 86.

More particularly, in this embodiment (as shown in FIG. 7), the hold open mechanism 120 and locking mechanism 124 includes a closed loop hydraulic circuit 140 including at least one check valve 142, a heat sink 146, a control valve 150 and at least one accumulator 154. In this embodiment, there are two check valves 142, and they are incorporated into the piston 134. The accumulators 154 are used to maintain pressure and accommodate the volume differences between the top (shaft) and bottom (open) portions of the cylinder 132.

The control valve 150 controls the hydraulic fluid flow through the conduit from one of the chambers to the other chamber. In this way, when the control valve 150 is closed, the hydraulic fluid is prevented from flowing between the chambers so that the latch jaw 104 remains locked and the dipper door 86 is prevented from moving. When the control valve 150 is opened, the hydraulic fluid is allowed to flow between the chambers and the dipper door 86 is allowed to move.

Preferably, the control valve 150 is a solenoid valve that is controlled by way of a remote switch (not shown) operated by the power shovel operator. Such valves are commonly known to those skilled in the art and are also readily available from numerous commercial sources. Power can be supplied by a 24V rechargeable battery pack mounted in the top of the dipper door 86 and activated by an RF signal. Another method would be to mount a cable take-up reel on the boom 22 and attach the cable to the top of the door 86. This would allow the control valve 150 to be hard wired.

When the dipper door 86 is latched the latch jaw 104 is biased to rotate to release from the latch opening 100 by the pressure difference in the cylinder assembly 128 caused by the greater area in the non-rod end of the cylinder 132, but is held in place by the control valve 150. The hold open mechanism 120 comprises the at least one accumulator 154 that provides the residual pressure that extends the cylinder assembly 128 to its maximum extension. Any excessive heat is accounted for through the heat sink 146.

In operation, when the door 86 slams shut, the hydraulic cylinder assembly 128 will be displaced transferring fluid through its piston 134 via the series of internal check valves 142. Once engaged, the piston 134 is fully retracted. The cylinder assembly 128 cannot extend, due to the hydraulic lock. The cylinder assembly 128 is under tension when the latch jaw 104 is engaged.

Second Embodiment

Figure 9:
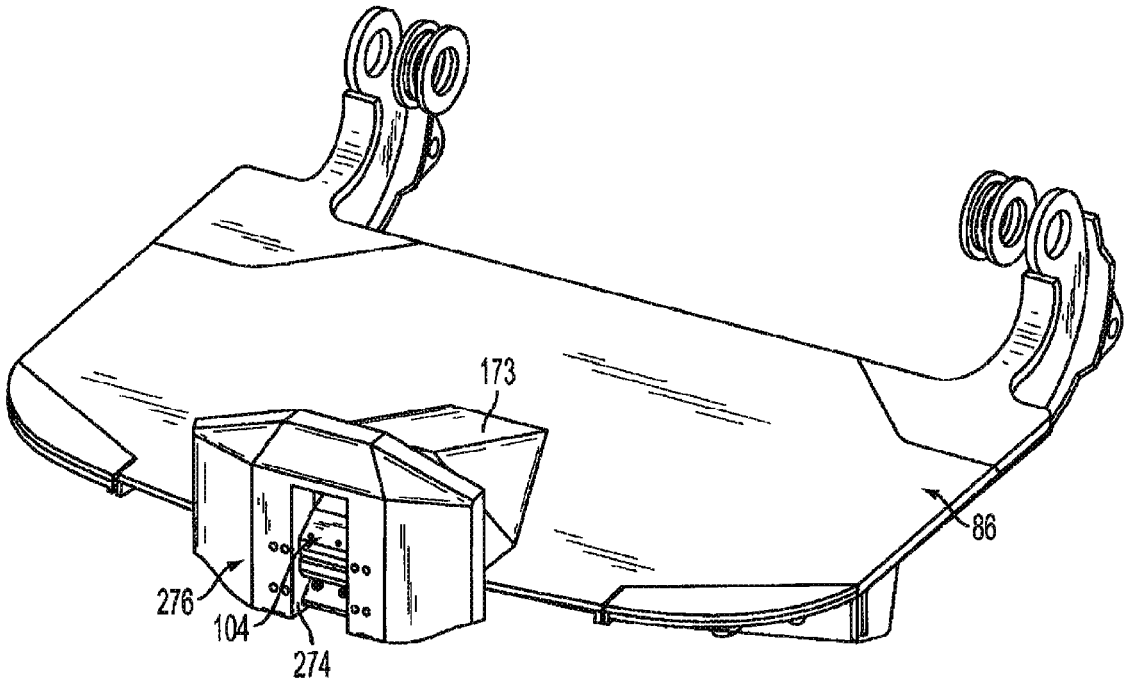
FIG. 9 is a perspective view of the dipper door and latch keeper of this invention.
Figure 10:
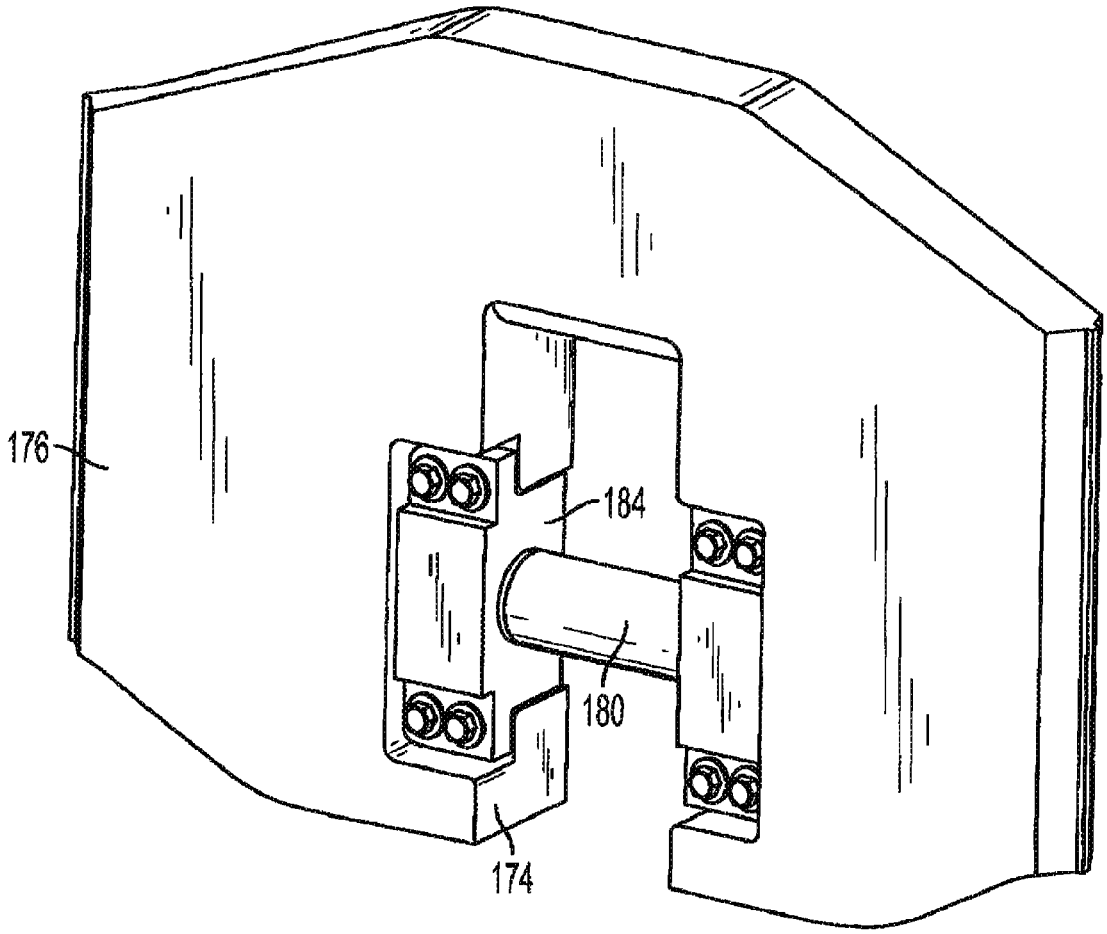
FIG. 10 is a perspective view of the latch keeper of this invention.
Figure 11:
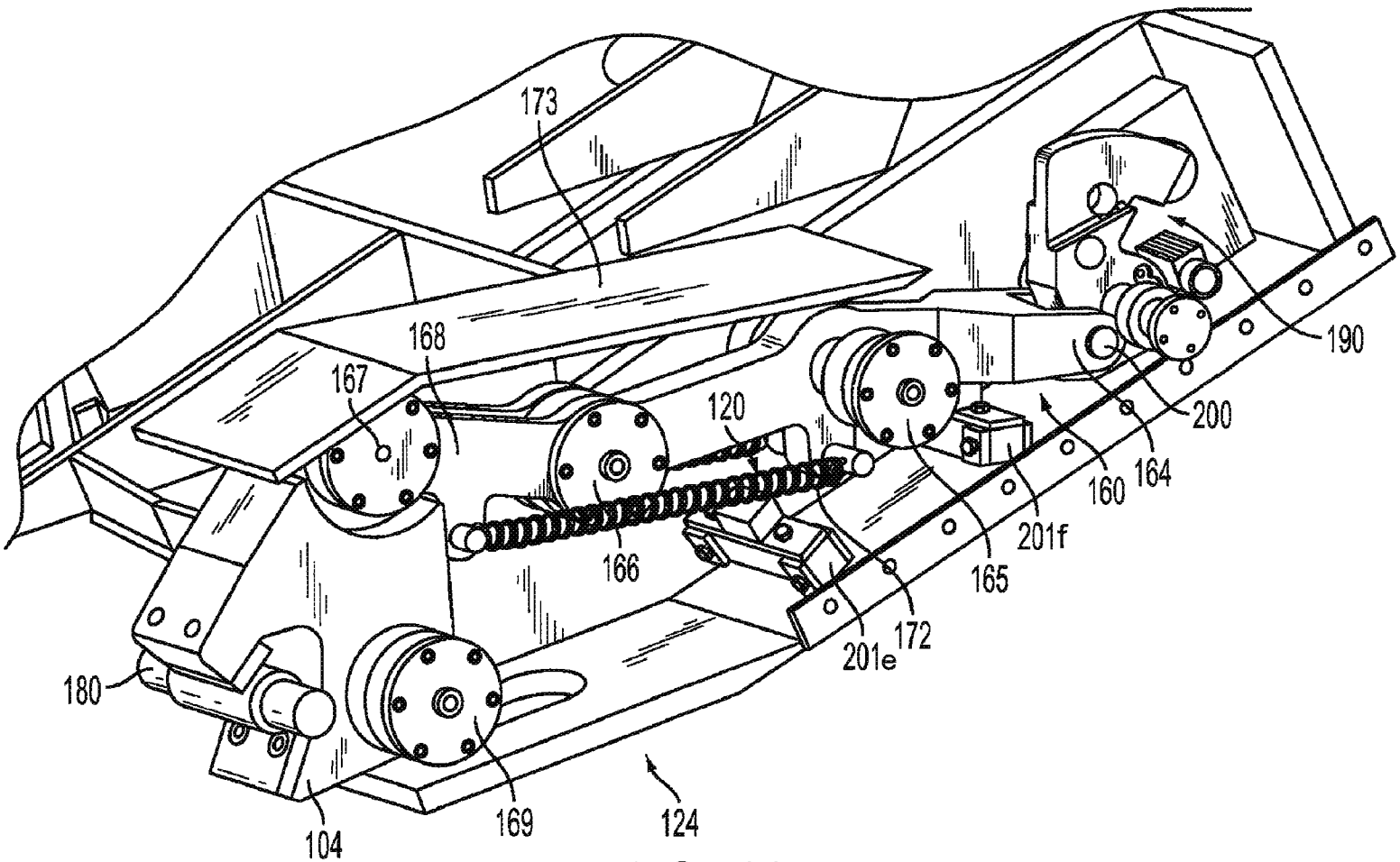
FIG. 11 is a partial broken away side perspective view of another embodiment of the latch mechanism of this invention, with the latch in a door-closed position.
Figure 12:
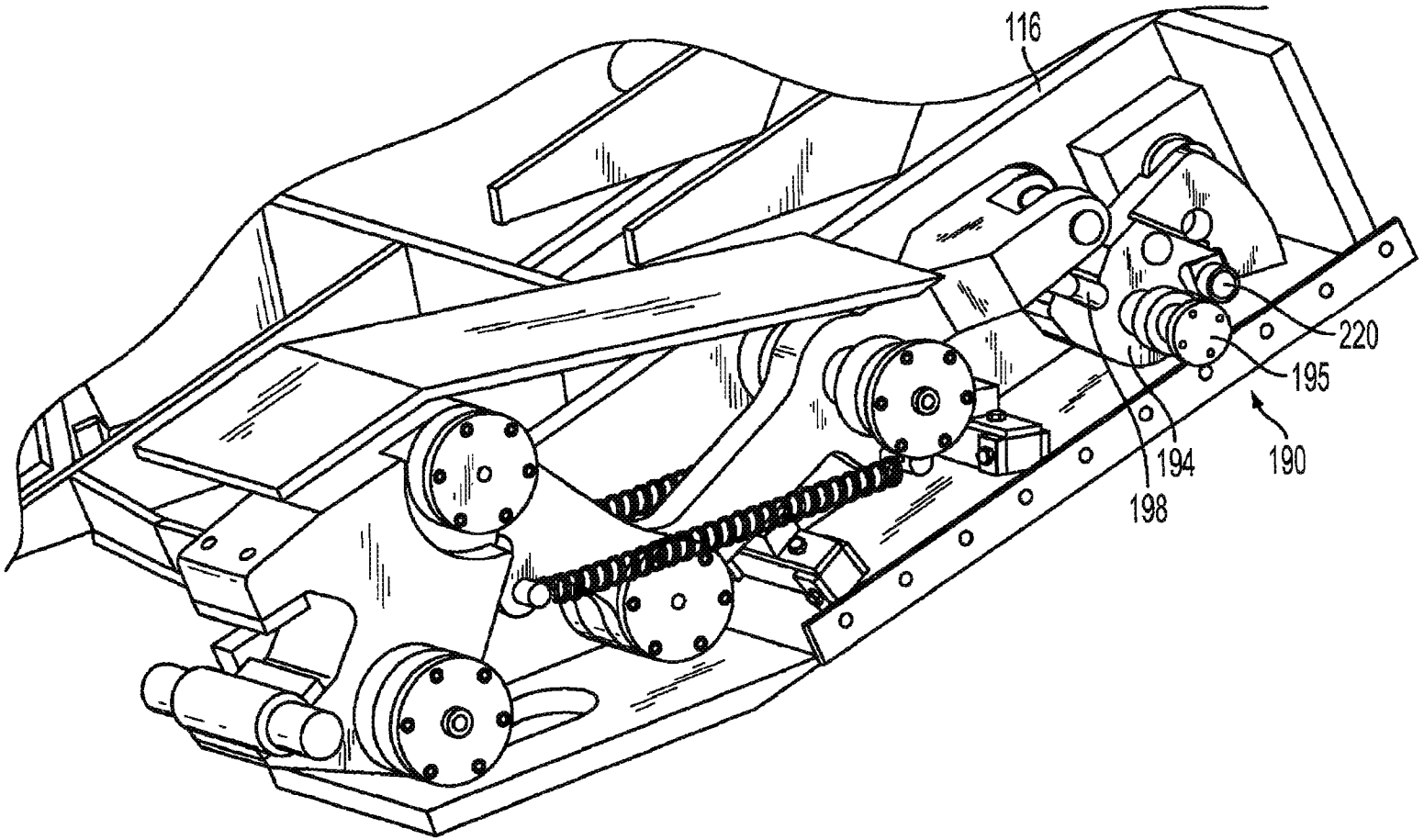
FIG. 12 is a partial broken away side perspective view of the embodiment of the latch mechanism shown in FIG. 11, with the latch in a door-opened position.

In another embodiment, shown in FIGS. 9 through 16, like numerals identify items described previously. As illustrated in FIGS. 11 and 12, the locking mechanism 124 in this embodiment includes a primary locking mechanism 160 including one bar 164 pivotally attached at 165 to the door 86, and another connecting bar 168 pivotally connected to and extending between each of the one bar 164 at 166 and the latch jaw 104 at 167. The latch jaw 104 is pivotally connected to the door 86 at 169. Further, the hold open mechanism 120 in this embodiment is means biasing the latch jaw 104 into its open position in the form of a tension spring 172 attached between the one bar 164 and the connecting bar 168. More particularly, in this embodiment, there is one spring 172 on one side of the one bar 164 and the connecting bar 168 and a similar spring (see FIG. 12) on the opposite side of the one bar 164 and the connecting bar 168. When locking the locking mechanism 124, the pivot connection 166 between the one bar 164 and the connecting bar 168 travels through the spring 172, which helps to drive the latch jaw 104 into the locked position and hold the latch jaw 104 closed, as further explained below. The latch jaw 104, the tension springs 172 and the locking mechanism 124 are located between two of the support ribs 116 (only one of which is shown in FIGS. 11 and 12), and are protected by a protective cover 173.

In this embodiment, as illustrated in FIGS. 9 and 10, the latch opening 100 in the dipper body 62 is in the form of a cutout 174 formed in a striker plate 176 that is a part of, such as by being welded, the dipper body front wall 70. A striker bar 180 extends across the cutout 174 parallel to the plane of the dipper discharging opening 82, the latch receiving opening 100 being defined by the striker bar 180 and the striker plate 176. The jaw chin 112 impacts the striker bar 180.

The dipper striker bar 180 serves the important purpose of anchoring the dipper door 86 to the dipper body 62 through the latch link engagement. The construction of the striker bar 180 is a round pin, and the pin is allowed to rotate under load because it has bushed supports 184. This is significant because sliding friction between the latch jaw 104 and the striker bar 180 is eliminated. In addition, the large contact load between the latch jaw 104 and the striker bar 180 is relieved instantly when the door 86 is unlatched. That is, there is no constant high and dry contact load acting over a significant length like there is in a sliding friction door latch. Shims (not shown) can be placed between the bushed supports 184 and the cutout 174 to adjust the position of the striker bar 180, when desired.

The rotatable latch jaw 104 that acts as the forward link of this four bar primary locking mechanism 124, rotates and curls around a striker bar 180 when the jaw chin 112 strikes the striker bar 180 upon door re-latch. The tension springs 172 are positioned such that the rotatable latch 104 is driven with extra rotational impetus to provide a controlled and positive re-latch. Re-latch is achieved in this manner as the latch jaw 104 curls around the striker bar 180 and is positively held in that position by the locking and holding power of the primary locking mechanism 160.

The various pivot points in the primary locking mechanism 160 have the added advantage in that they can be lubricated with the lubricant held locally in place with pin retention systems. Also, these pin joints can be lined with replaceable bronze bushings to protect the parent linkage material.

The mechanism remains in the unlatched, collapsed condition thanks to the springs 172 that effectively control and hold the mechanism bars or links in the door-opened position as long as the door 86 is unlatched. In this door-opened position, rotation is limited by the bumper stop **201*e*. The one bar 164 is held against the bumper stop 201*e* by the tension springs 172 as shown in FIG. 12. The tension springs 172 also prevent the latch jaw 104 from extending back into the latched position, for if the latch jaw 104 were in the latched position, the latch jaw 104 would not be in the proper position to permit the door to shut again. As the empty shovel dipper 38 is lowered and swung backward to start a new dig cycle, the dipper 38 with the striker bar 180 swings into the hanging dipper door 86, so that the bottom portion or jaw chin 112 strikes the striker bar 180 and is driven back into the closed position. The tension springs 172 again serve their dual purpose because the springs 172 now act to drive the latch jaw 104 into engagement as the latch jaw 104 curls around the striker bar 180**.

Figure 13:
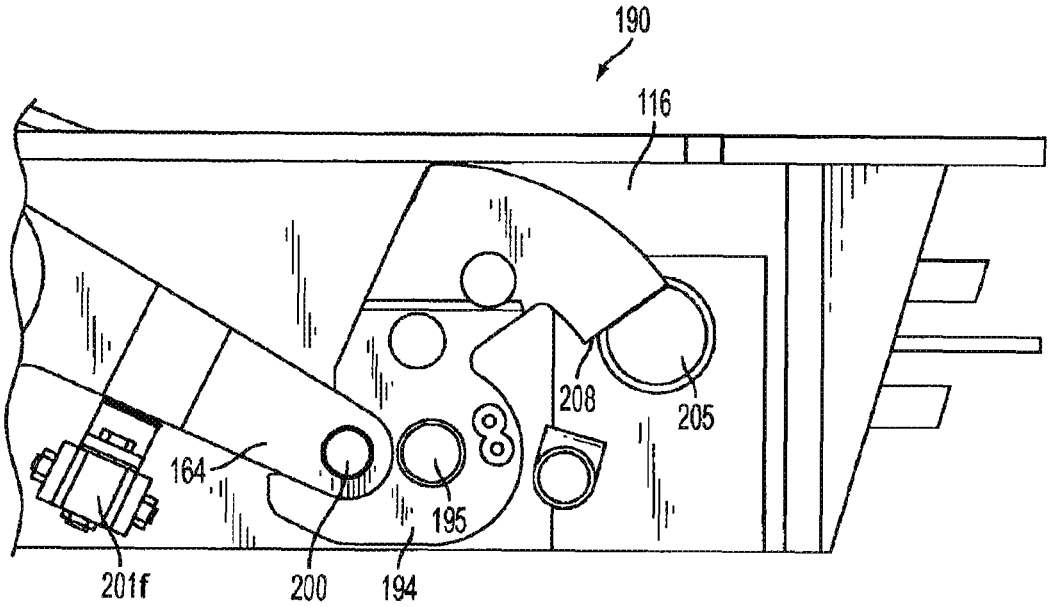
FIG. 13 is a side view of the secondary latch mechanism of the latch mechanism shown in FIGS. 11 and 12, with the secondary latch in a bar holding position.
Figure 14:
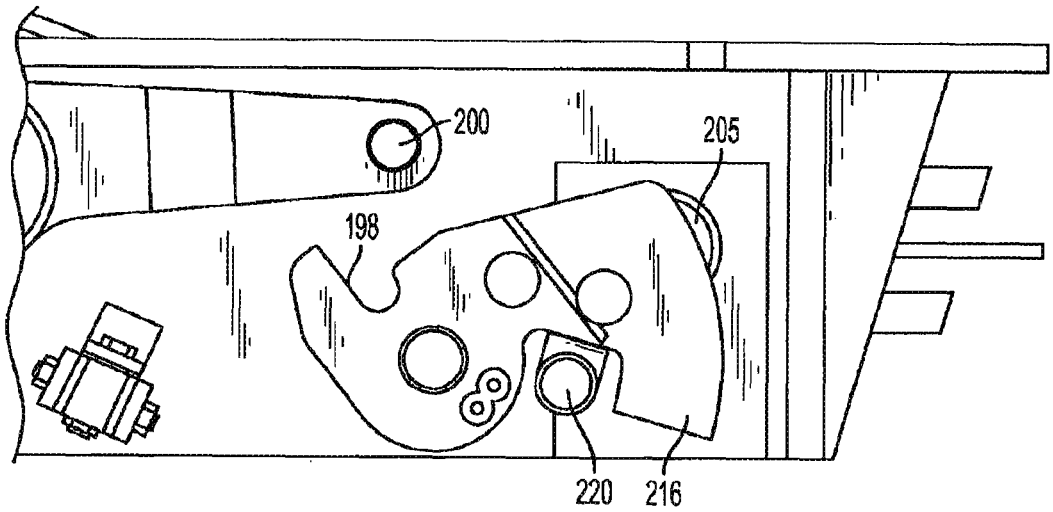
FIG. 14 is a side view of the secondary latch mechanism of the latch mechanism shown in FIGS. 11 and 12, with the secondary latch in a bar released position.

In order to lock the locking mechanism 124, the locking mechanism 124 also includes a secondary latch 190, as illustrated in FIGS. 11 through 15 and 17. The secondary latch 190 is under much less load but controls the engagement of the primary latch holding the dipper door 86 to the dipper body 62. The secondary latch 190 comprises a bar holder 194 pivotally mounted at 195 on the dipper door 86, the bar holder 194 having a bar holding indentation 198, the indentation 198 receiving the one bar end 200 and preventing movement of the one bar end 200 when in a bar holding position (FIG. 13) and permitting movement of the one bar end 200 when in a bar releasing position (FIG. 14). The locking mechanism 124 is locked by impact of the one bar end 200 into the secondary latch bar holder 194, and movement of the bar holder 194 into the bar holding position, as further explained below.

When the dipper door 86 is latched and under heavy load due to the material within the dipper, the primary latch mechanism is under heavy load and the bars want to collapse so the latch wants to disengage the striker bar 180 allowing the door 86 to open. This tendency of disengagement exists because the four bar linkage approaches the toggle but is held by mechanical stops 201 and by the secondary latch 190 to be about 18 degrees short of toggle. The "tripping" or unlocking of the secondary latch 190 allows the bars of the primary locking mechanism 160 to collapse and the latch jaw 104 to rotate out of engagement with the dipper body 62. Bar 164 collapses against bumper stop 201*f*, which absorbs the unlatching energy (see FIG. 12).

Figure 15:
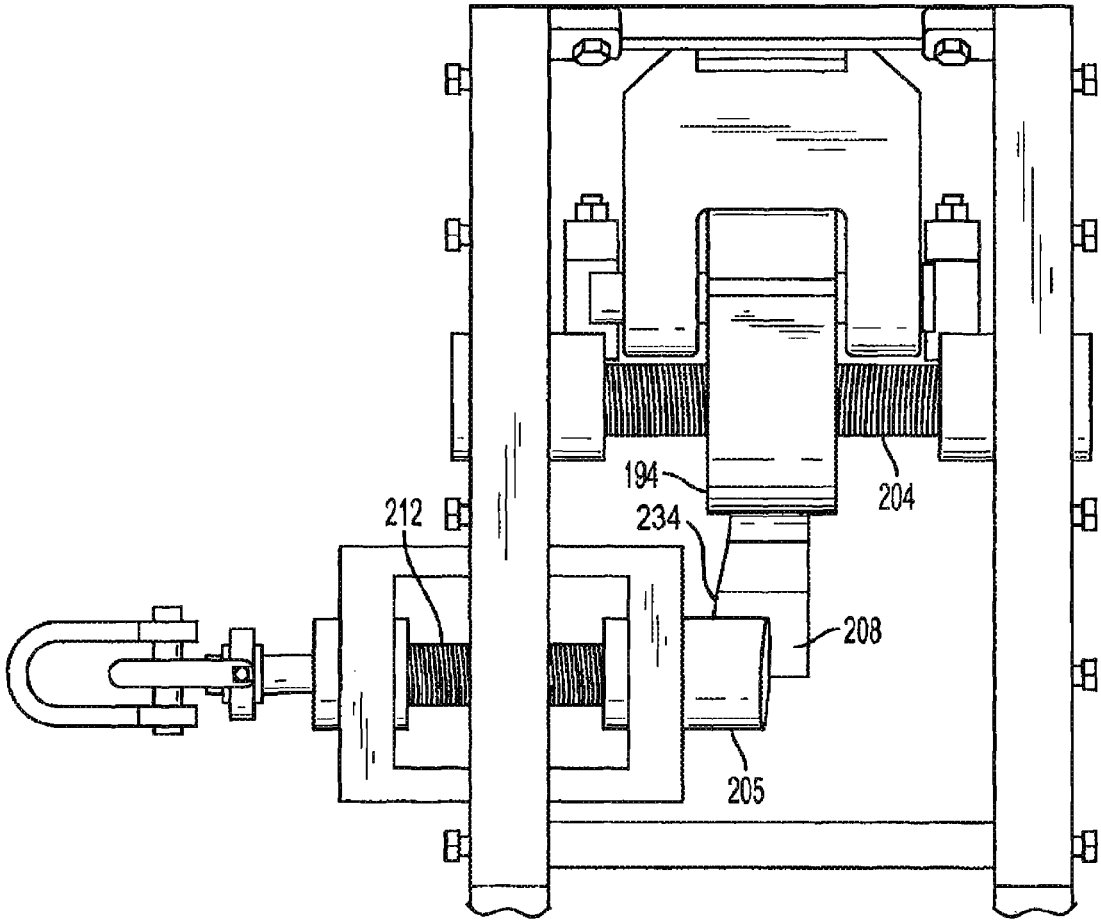
FIG. 15 is a bottom view of the locked secondary latch mechanism shown in FIG. 13, with the bumper stop 220 removed.
Figure 16:
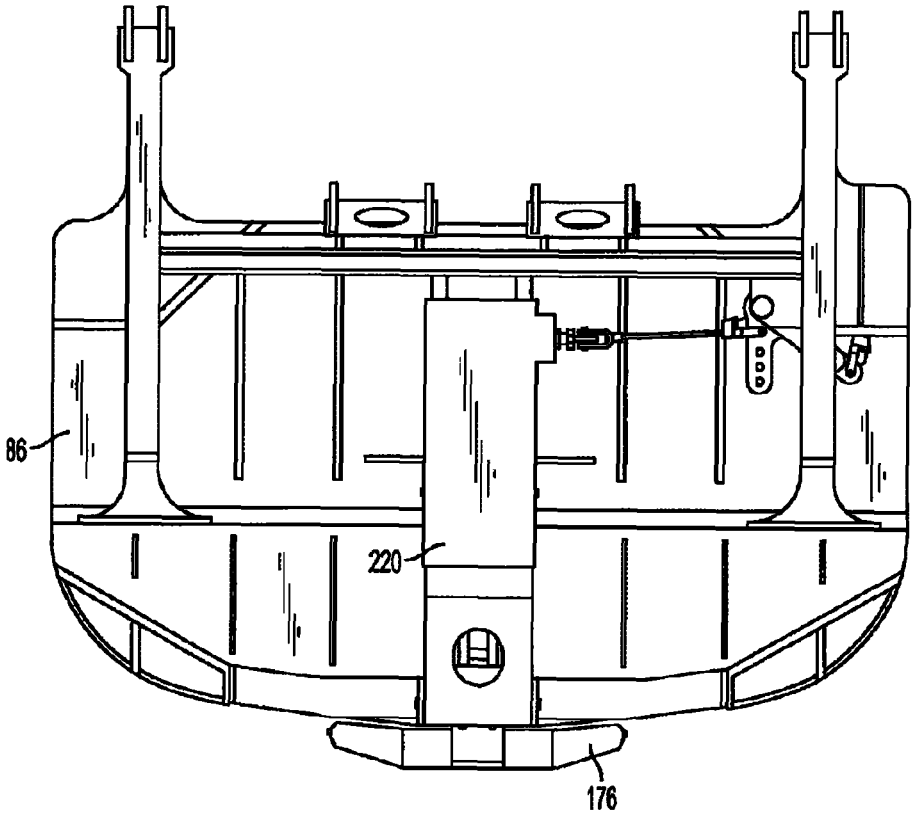
FIG. 16 is a bottom view of the dipper door of this invention.

As best illustrated in FIG. 15, the bar holder 194 is biased by a weak spring 204 and by bar 164 which is under great bias to push the bar holder 194 toward the bar releasing position (see FIG. 14) but is held in locked position by a plunger 205 that engages an end 208 (see FIG. 13) of the bar holder 194. The plunger 205 slips into the bar holding position when the secondary latch moves into the bar holding position, as shown in FIGS. 13 and 15. The plunger 205 is biased toward the bar holder 194 by a strong compression spring 212 (see FIG. 15).

Figure 17:
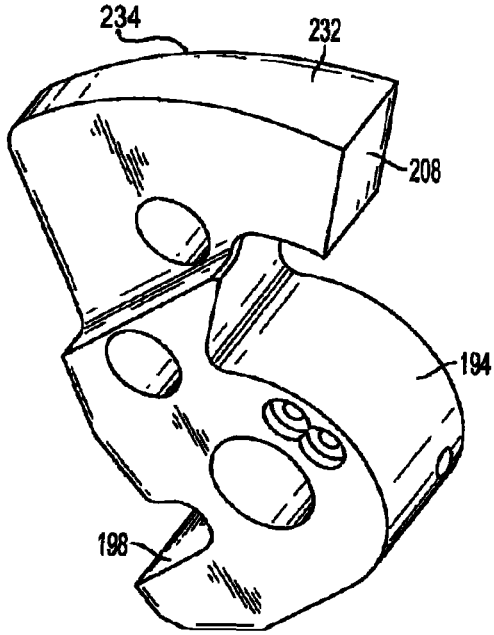
FIG. 17 is a perspective view of the bar holder 194 in FIG. 13.

When the bar end 200 strikes the bar holder 194 on its way to the latch position, the weak spring 204 allows the bar holder 194 to maintain its positioning against the bumper stop 220 to allow the bar holder 194 to "catch" the bar end 200 in the latched position in the bar holding indentation 198 of the bar holder 194. If the bar holder 194 travels past its bar holding position, the weak spring 204 helps to bring the bar holder end 208 back into engagement with the plunger 205. Referring to FIGS. 15 and 17, as the bar holder 194 rotates to its latched position, the bar holder end 208 has an inclined surface 234 that engages the end of the plunger 205. The bar end 200 striking the bar holder 194 drives the bar holder inclined surface 234 to forcibly push the plunger 205 out of the way. The bar holder end 208 then over travels slightly to allow the plunger 205 to extend under force of the strong compression spring 212 to thereby prevent the bar holder end 208 from any rotational movement that would unlatch the locking mechanism 124. The plunger 205 therefore locks the secondary latch 190, which in turn locks the primary locking mechanism 160.

This weak spring 204 effect guarantees a successful latch even when the latching force is very small, thus giving the locking mechanism 124 a "soft latch" feature. The soft latch feature is desirable because the shovel operator does not have to deliberately try to slam the door 86 shut for a successful door latch. The strong compression spring 212 on the plunger 205 is stiff enough to resist inadvertent inertial loads on the trip cable. This helps to eliminate unintended false trips due to cable slack take up when the dipper handle 26 is suddenly extended or retracted. The strong compression spring 212, however, can be overcome by the very deliberate operator act of tripping the cable via cable pull from a motor driven drum.

In operation, the latch jaw 104 is held in the latched position by the bar holder 194 that holds onto the bar end 200 of the primary locking mechanism 160 until the operator trips the secondary latch 190. The primary locking mechanism 160 extends to a position just short of a full toggle position. As a result, the mechanism wants to collapse away from the toggle position under gravity. The secondary latch 190 prevents it from doing so and the door 86 is locked.

The instant the latch jaw 104 curls around the striker bar 180, the bar holder 194 grabs the bar end 200 of the one bar 164 and keeps the locking mechanism 124 from collapsing again until the operator trips the secondary latch 190. The impact is not considered great during routine shovel digging but the momentum of the heavy door 86 and dipper 38 drive the relatively light linkage to the latched position just in time for the dipper 38 to start a new dig cycle through a bank of material.

Figure 17A:
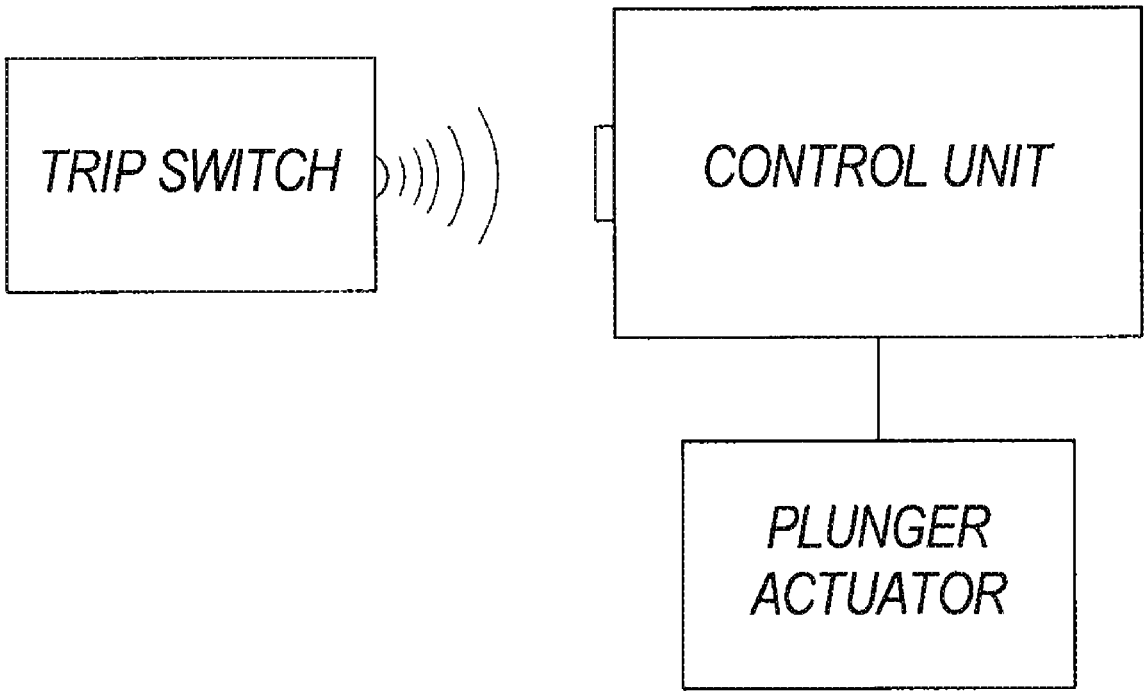
FIG. 17A is a schematic illustration of the trip system for the secondary latch mechanism.

The secondary latch mechanism 190 can take on many different mechanical configurations (not shown) and can be triggered by many different methods including pneumatic, hydraulic, electromagnetic solenoid, and mechanical cable pull. In the preferred embodiment shown in FIG. 17A, the secondary latch plunger 205 is remotely triggered with an RF signal, as is done with a garage door opener. This eliminates all maintenance intensive trip motors, trip cables, and cable pulleys.

The fixed pivot location of the secondary latch 190 is located directly above and in line of the bar holding indentation 198 that holds the bar end 200 in the latched position. As long as this position holds, or that the bar holding indentation 198 is somewhat to the right of this line of action, then the latch jaw 104 will not rotate and is locked in place. The end 216 of the bar holder 194 opposite the end with the bar holding indentation 198 engages a mechanical stop in the form of a bumper stop 220 and insures the bar holding indentation 198 is in the proper position to receive the bar end 200. The bar holder 194 will press against this bumper because of torsional tension supplied by the weak spring 204.

Rotation of the secondary latch is limited in the latching position by the bumper stop 201*f*. The bumper stop 201*f* is located precisely in a position to allow the bar holder 194 to over travel slightly to allow the plunger 205 to fully extend to lock the bar holder 194 from rotating back into the unlatched position.

In an alternate embodiment (not shown) the location of the secondary latch can be placed at the pivot connection 166 between the two bars, if needed. It is shown at the end of the link extension to keep it out of harms way. As you locate nearer the tip of the door 86, the greater the possibility of seeing material plowing and contamination during use.

The secondary latch 190 is tripped by pulling the plunger 205 out of engagement with the bar holder 194. This allows the bar holder 194 to release the bar end 200 of the primary locking mechanism 160. The weight of the door 86, and the weight of the material in the dipper 38 which exerts additional weight on the door 86, produces a rotational moment on the latch jaw 104 forcing it to rotate out of engagement. The linkage system will accommodate the rotation of the latch because the linkage is just short of the toggle point, not at the toggle point, and not beyond the toggle point where it would fail to move. The bumper stop 201*f* insures that the mechanism will not reach toggle nor go beyond toggle. When the latch rolls out of engagement, the mechanism collapses and the door 86 opens. Latch rotation out of engagement does not generate any significant sliding friction because the striker bar 180 is allowed to rotate within the bushings that support it in the cradle of the dipper body 62. The sudden latch rotation results in the sudden release of latch loads that do not have to be resisted by any objects in contact. Sliding friction under large sliding loads is eliminated.

The door 86 falls open releasing the load within the dipper 38. The mechanism is held in the collapsed state by the pair of tension springs 172. This is necessary to hold the latch jaw 104 in the proper orientation for the jaw chin 112 to strike the dipper striker bar 180 upon re-latch. The tension springs 172 mounted uniquely with respect to the mechanism toggle point, therefore, hold the latch jaw 104 in the proper position after unlatching and drive the latch jaw 104 closed upon re-latching. In a less preferred embodiment (not shown), torsional springs could be incorporated at the pivot connection 166 to achieve the same behavior.

The addition of the tension springs 172 to the linkage is an important controlling feature of the mechanism. Without the springs 172 the linkage would not be held in the collapsed position with the latch jaw 104 wide open and ready for re-latch. The springs 172, located outboard on either side of the bars, serve a dual purpose in that upon re-latch the spring force line of action transfers from one side of the pivot connection 166 to the other side. As the lower latch jaw 104 strikes the dipper striker bar 180 upon re-latch, the spring line of action passes across the pivot connection 166 and now serves to drive the latch jaw 104 rotation to curl around the striker bar 180 and remain in the latched position.

As the latch jaw 104 curls around the striker bar 180, the tension spring line of action now acts on the other side of the pivot and "kicks in" and provides impetus to drive the latch jaw 104 into engagement with the striker during re-latch.

The unique rotational dipper door latch does not require the high forces generated by hydraulics to open and close. The rotational dipper door latch uniquely closes under gravity, latches with a positive lock on the striker bar 180, and requires a relatively small tripping force to unlatch.

The secondary latch in essence controls the toggle point of this four bar linkage because the bar involved in the toggle is extended away from all the link motion toward the back of the dipper 38, but sees the same reduced load. The secondary latch therefore takes advantage of the inherent mechanical advantage of a pivot-approaching toggle. Any dry sliding friction loads in the secondary latch are miniscule compared to the original design friction loads in the primary latch arm, and therefore the invention eliminates the maintenance and reliability problems posed by the dry sliding friction.

Third Embodiment

Figure 18:
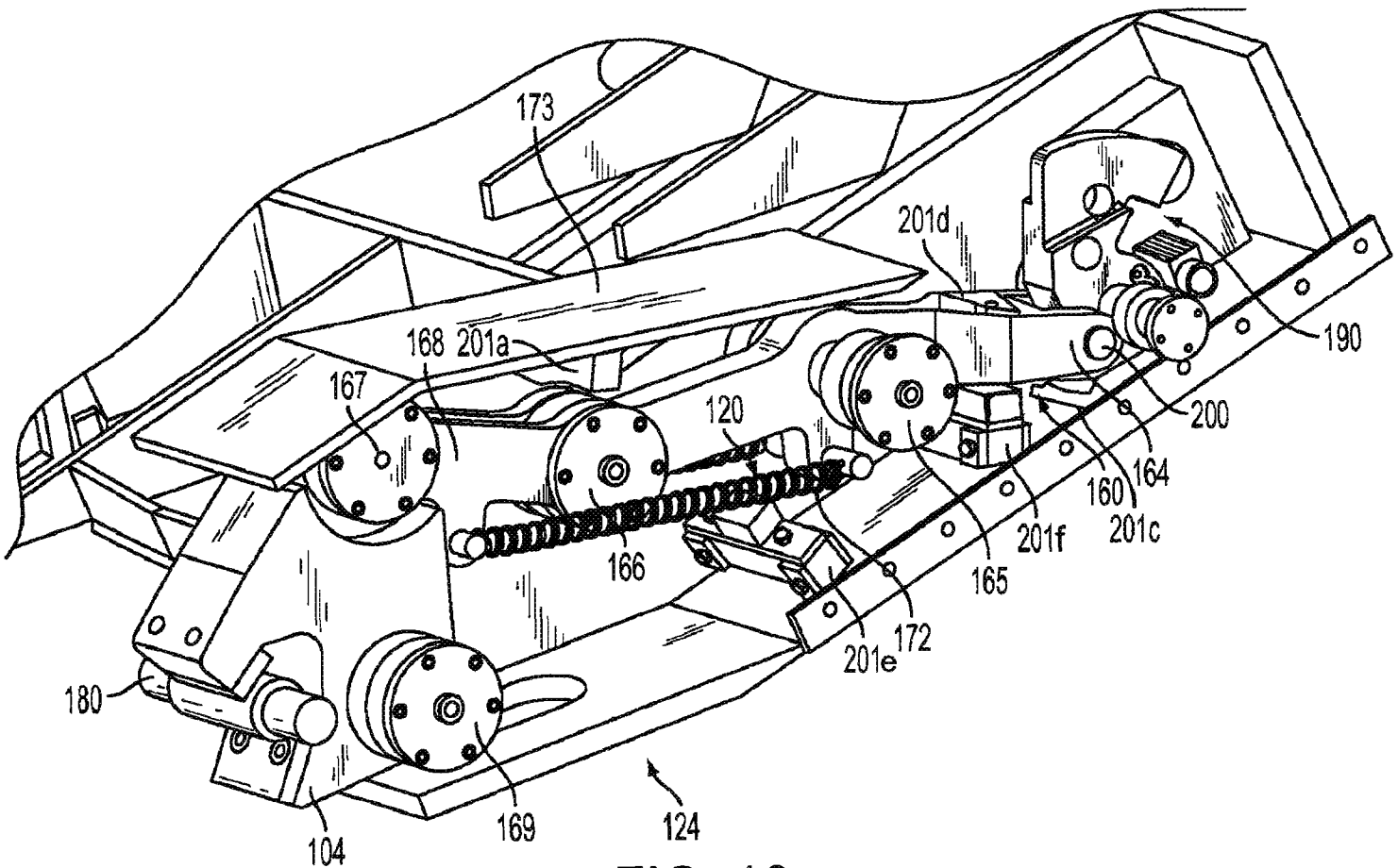
FIG. 18 is a partial broken away side perspective view of yet another embodiment of the latch mechanism of this invention, with the latch in a door-closed position, similar to FIG. 11.

A further and preferred embodiment of the latch mechanism is illustrated in FIG. 18. In this embodiment, additional bumper stops have been added. More particularly, a bumper stop 201*a* has been added to the top protective cover 173, and another bumper stop 201*c* has been added to the dipper door 86 underneath the bar end 200, so that as the pivot connection 166 between the two bars moves, the ends of travel contact the bumper stops 201*a* and 201*c*, and absorb energy within the pivot connection 166. Furthermore, a bumper stop 201*d* has been added to the top of the bar 164 so that, when the bar 164 contacts the upper protective cover 173, energy is absorbed by the bumper stop 201*d*.

Figure 21:
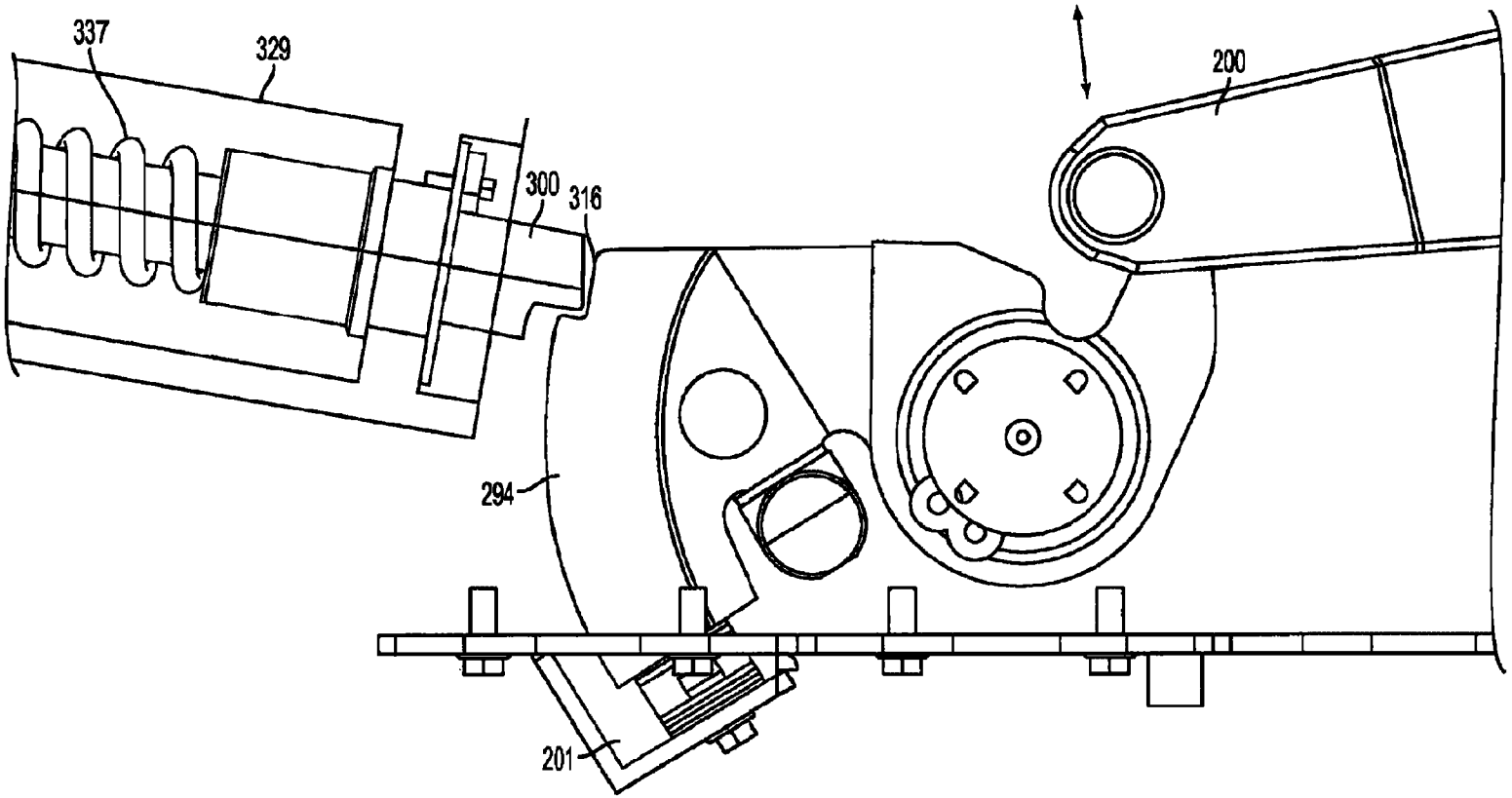
FIG. 21 is a side view of the bar holder shown in FIG. 19, with the added false latch prevention mechanism.

In another and preferred embodiment, the secondary latch mechanism further includes a false latch preventing mechanism 298, shown in FIG. 21. More particularly there are times where, when material hits the latch jaw 104, the latch mechanism may rotate to the latch closed position even though the dipper door 86 has not been closed. In order to prevent this from happening, a plunger 300 has been added located near a bar holder 294, substantially the same as bar holder 194, as illustrated in FIG. 21. The plunger 300 engages a notch 316 on the bar holder 294 when the dipper door 86 is not closed, thus preventing the bar holder 294 from rotating, and preventing the bar end 200 from being secured within the bar holder 294.

Figure 20:
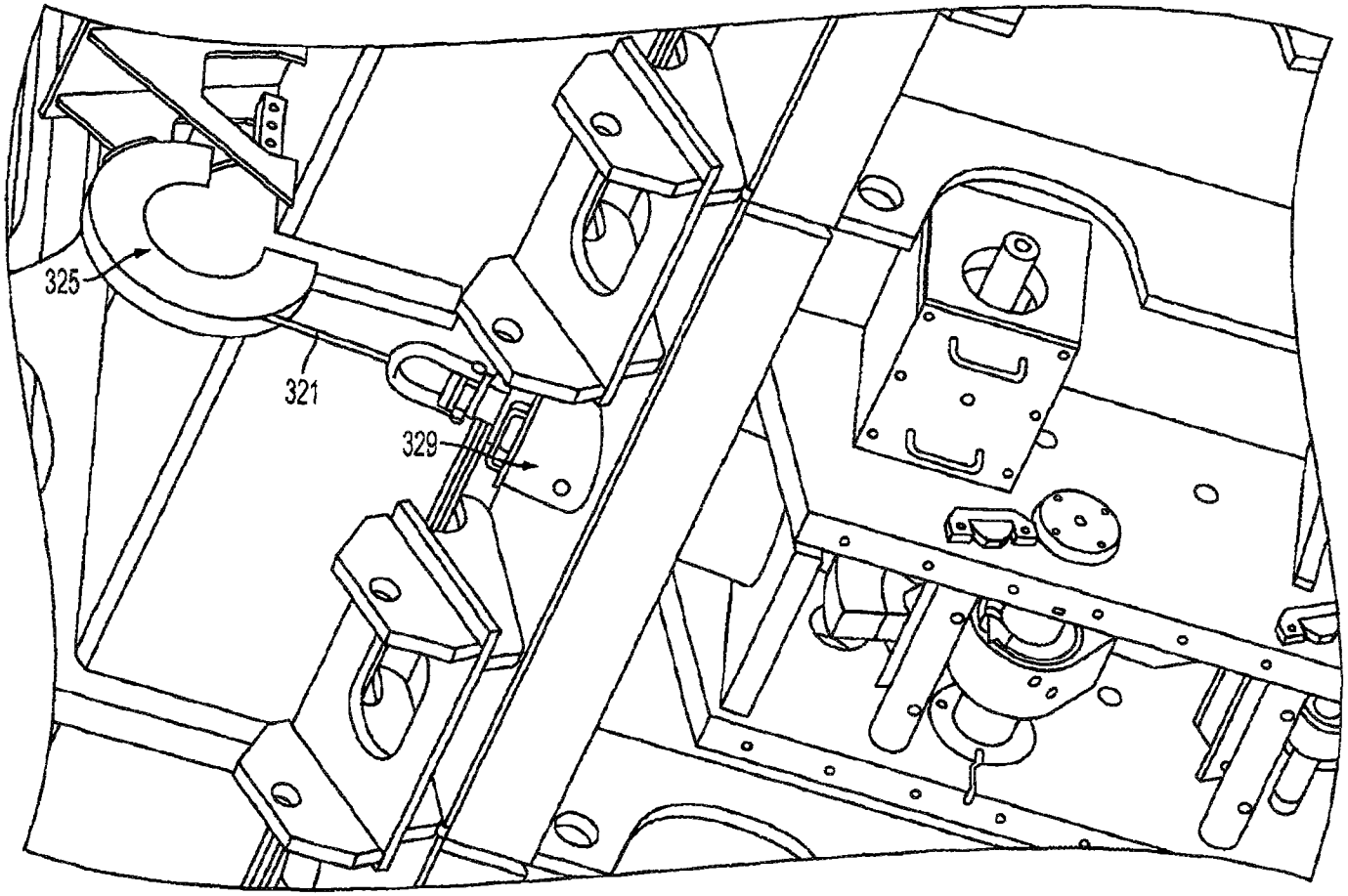
FIG. 20 is a perspective view of the latch assembly shown in FIG. 19, illustrating the added false latch prevention mechanism.

The plunger 300 is enclosed within a housing 329, and includes a seat 331 located within the housing 329, and a spring 337 located between the seat 331 and the housing 329 that biases the plunger 300 towards its extended position. The plunger 300 is connected to a chain 321, as illustrated in FIG. 20. The chain 321 extends from the plunger 300 and around a semi-spherical bracket 325 attached to the dipper body back wall 66. When the dipper door 86 is opened, and the chain 321 becomes slack, the spring 337 pushes the plunger 300 toward the bar holder 294, so that the plunger 300 engages the notch 316 on the bar holder 294.

Figure 19:
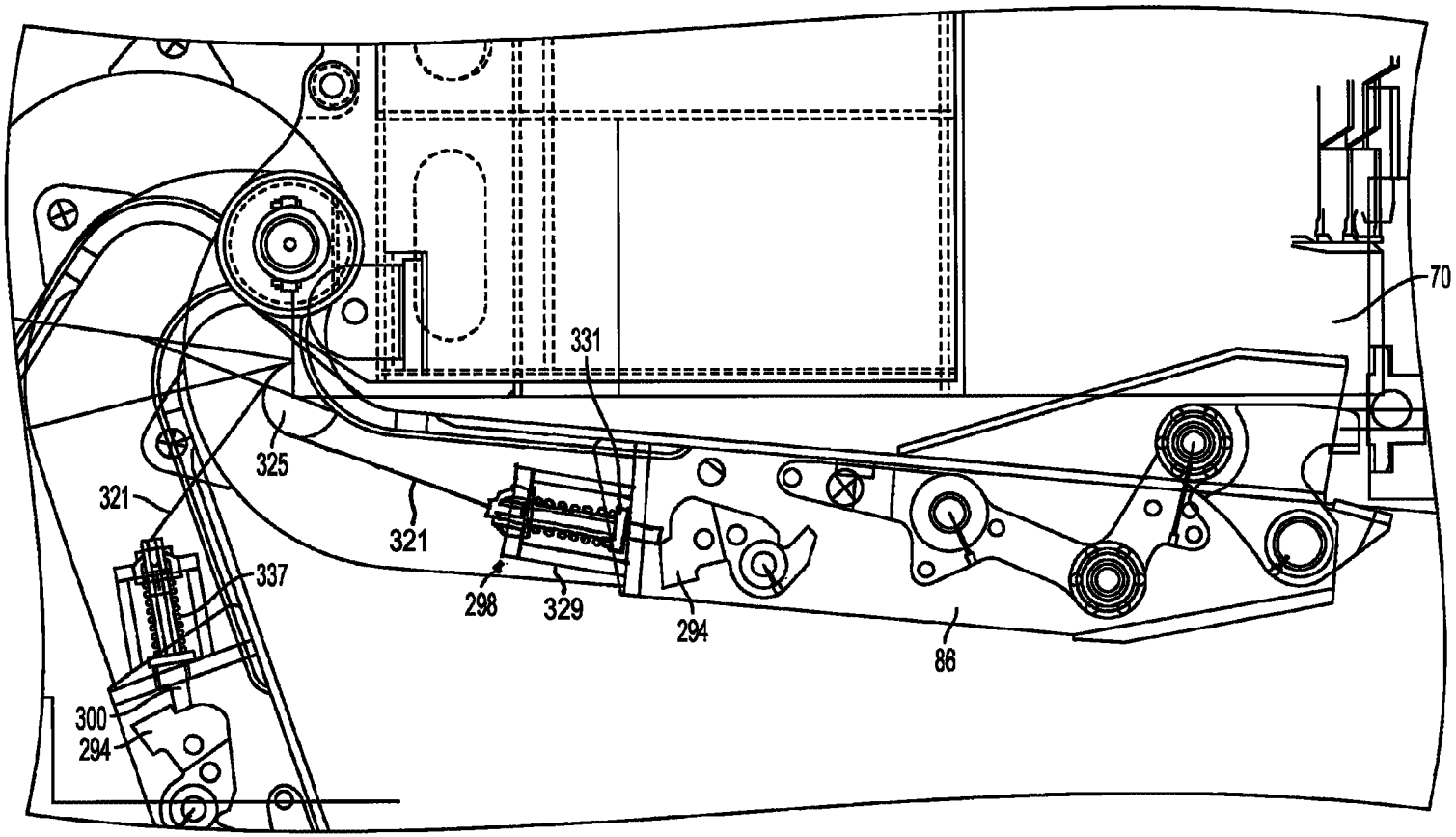
FIG. 19 is a cross sectional view of another embodiment of the latch assembly according to this invention, showing the dipper door mounted on the dipper body and in both a near latch and an open position.

As the door latch approaches the dipper body front wall 70, as shown in FIG. 19, the chain 321 becomes taut, pulling the plunger 300 away from the bar holder 294, and out of the notch 316, thus permitting the bar holder 294 to engage the bar end 200. The length of the chain 321 is adjusted to provide the proper timing for disengaging the plunger 300. If the chain 321 pulls the plunger 300 out of engagement with the bar holder 294 too soon, the latch may be susceptible to a false trip. If the chain 321 pulls the plunger 300 out of engagement with the bar holder 294 too late, the plunger 300 will prevent the striker bar 180 from moving the bar holder 294 into the closed position, and the door 86 will not close. Therefore, the length of chain 321 is fixed such that the plunger 300 is pulled out of engagement with the notch 316 at the proper time to avoid false latching while still allowing the door 86 to lock in the closed position.

Figure 19A:
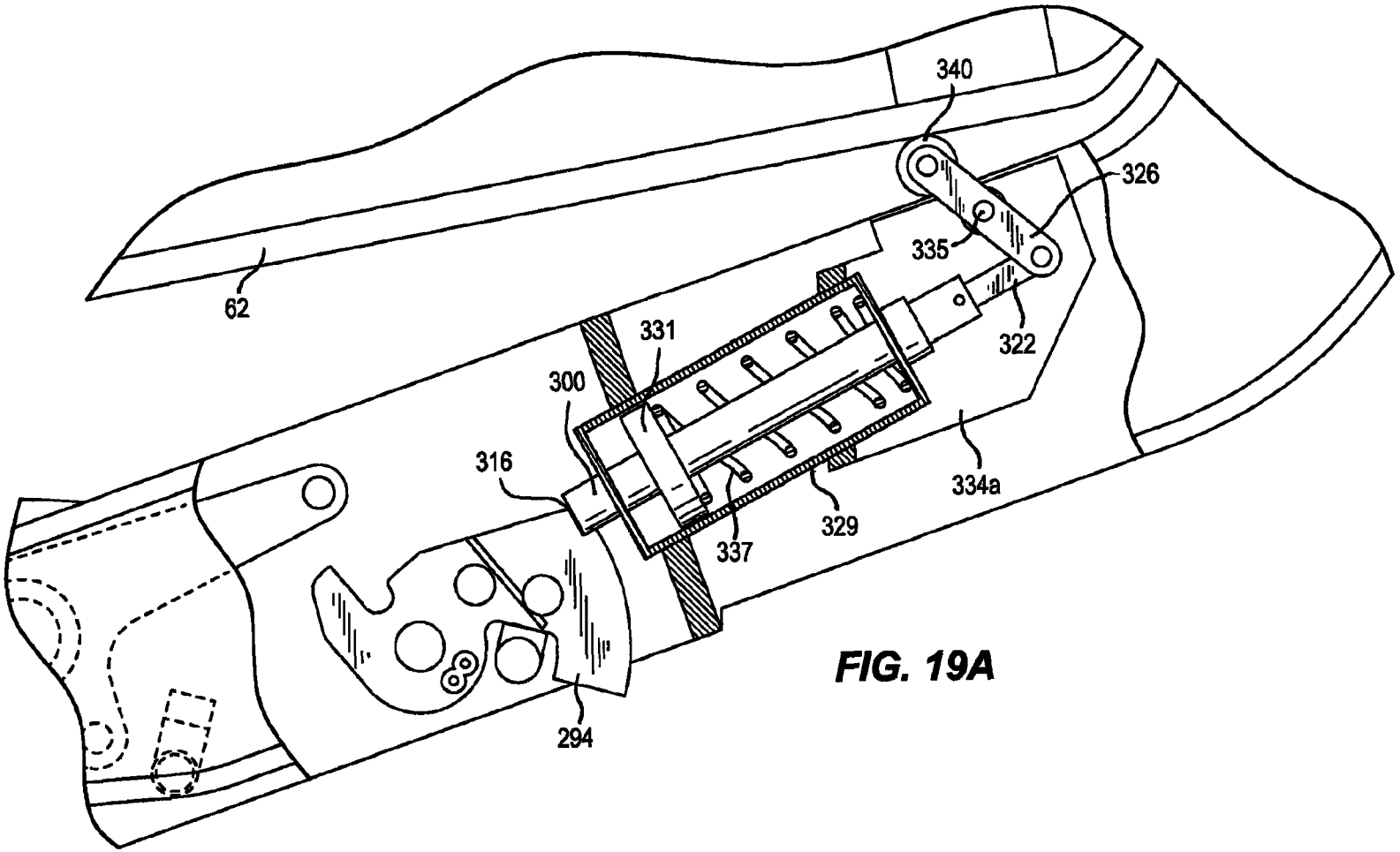
FIG. 19A is a cross sectional view of another embodiment of the latch assembly, showing the false latch prevention mechanism.
Figure 19B:
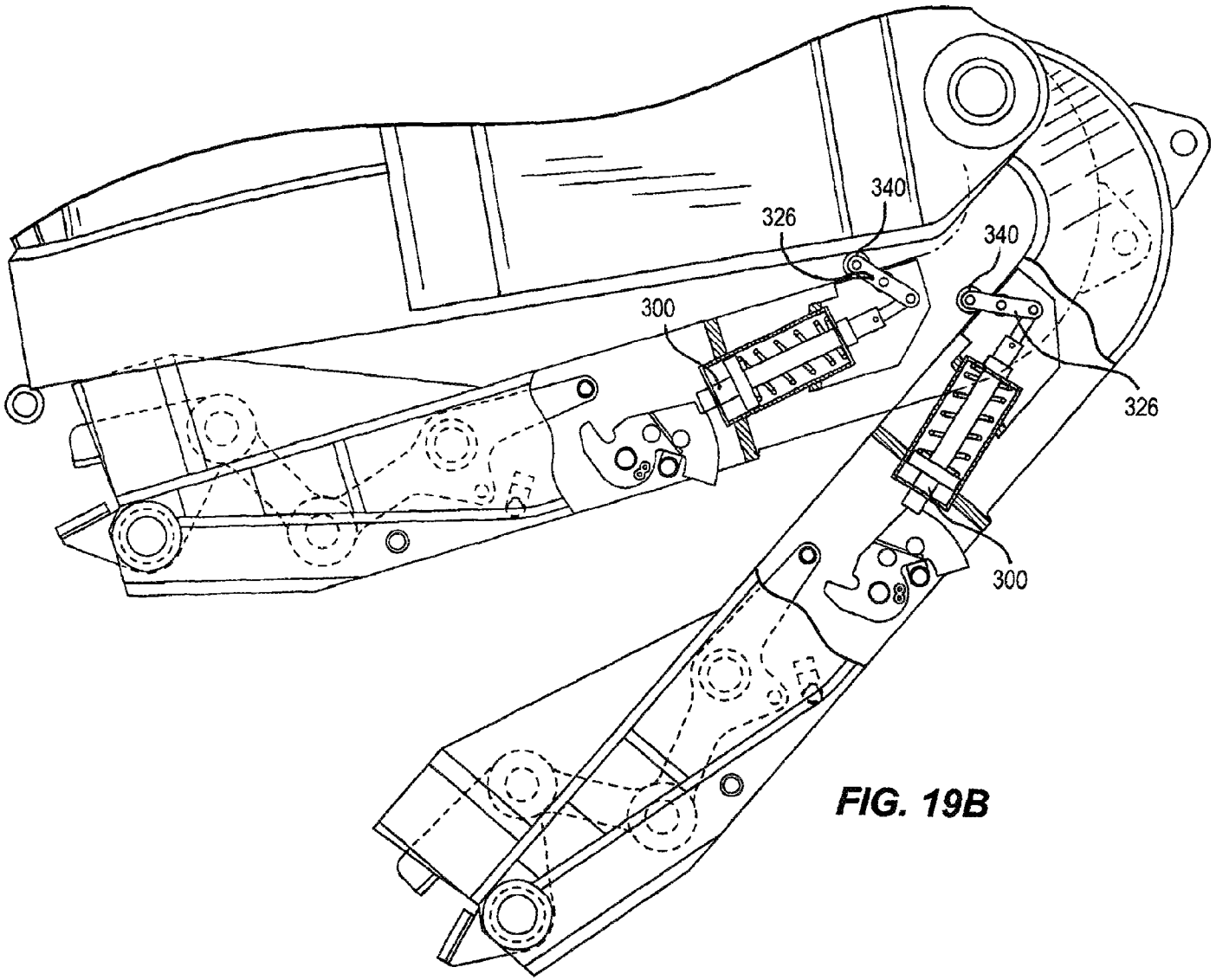
FIG. 19B is a cross sectional view of the latch assembly shown in FIG. 19A, showing the dipper mounted on the dipper body and in both a nearly closed position and an open position.

In another embodiment, solid links are used in place of the chain 321 and semi-spherical bracket 325. As shown in FIG. 19A, the plunger 300 is mounted in a housing 329 on the dipper door 86 adjacent to the bar holder 294. A notch 316 on the bar holder 294 receives the plunger 300, and the plunger 300 is biased toward engaging the notch 316 by the spring 337. A connecting link 322 is pivotably connected to the plunger 300 on one end and an extractor 326 on the other end. The extractor 326 has two ends. The extractor 326 is mounted between support walls 334*a* and 334*b* (only one of which is shown in FIGS. 19A and 19B) by pin 335, located between the two ends of the extractor 326. A rolling member 340 is rotatably mounted on the extractor 326 on the end away from the connecting link 322. Because of the biasing force exerted by spring 337 on the plunger 300, the extractor 326 is positioned such that the rolling member 340 is disposed to contact the dipper body 62 as the dipper door 86 is brought towards a closed position. Referring to FIG. 19B, as the dipper door 86 closes, the force exerted by the dipper body 62 on the rolling member 340 causes the extractor 326 to rotate about the pin 335. This rotation pulls the plunger 300 out of engagement with the bar holder notch 316. When the dipper door 86 is opened, the plunger 300 extends to engage the notch 316 due to the force of spring 337.

Figure 22:
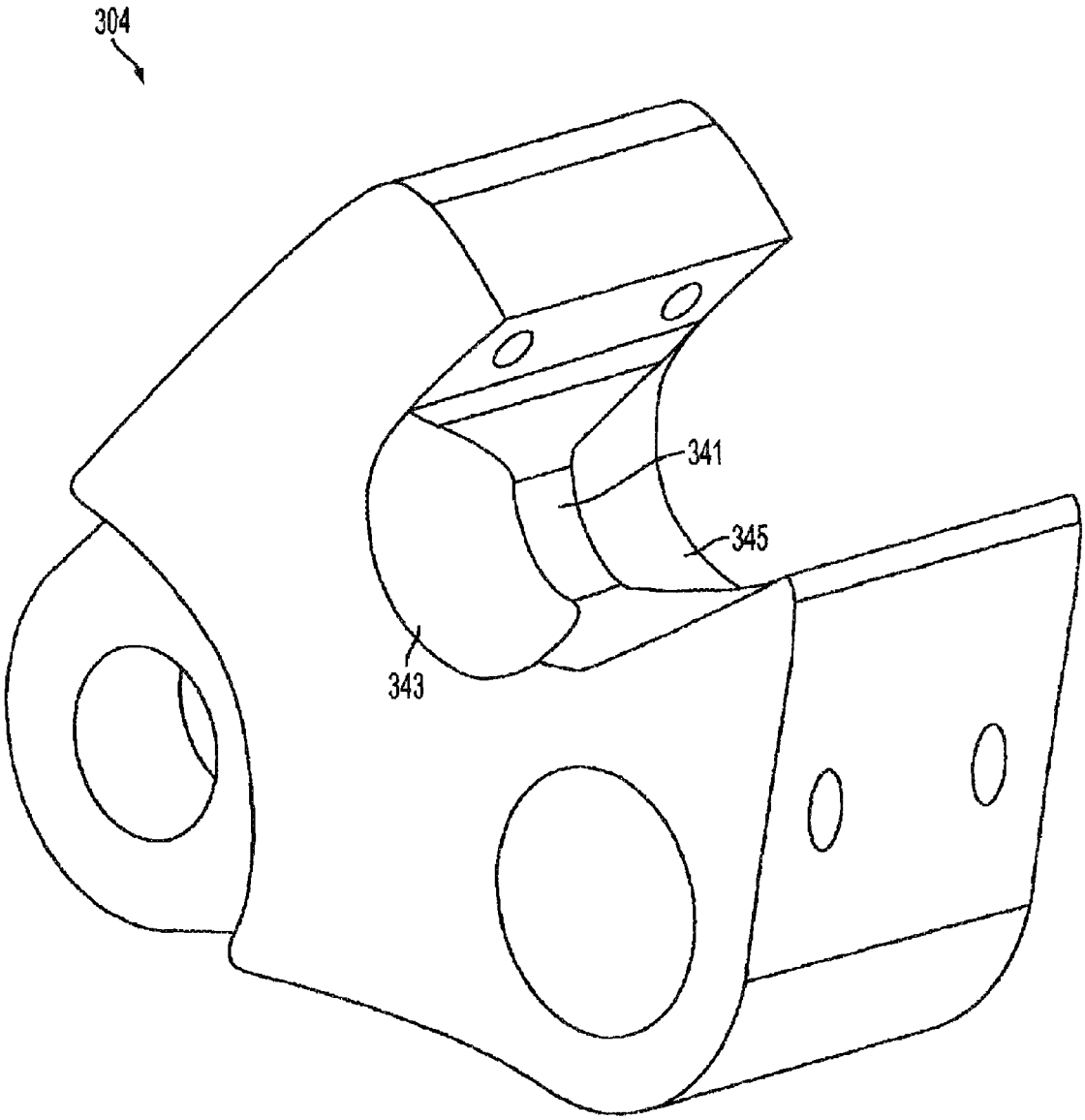
FIG. 22 is a perspective view of another embodiment of the latch jaw.

In another and preferred embodiment, a jaw 304 similar to the latch jaw 104 has been modified so that it no longer presents a large flat surface to the striker bar 180. More particularly, as illustrated in FIG. 22, the jaw mouth surface engaging the striker bar 180 now includes a relatively small central flat portion 341 and side portions 343 and 345 that angle away from the flat portion 341. This permits any dirt that may come into contact with the jaw 304 to then fall away from the jaw 304. This prevents significant dirt from remaining inside the jaw 304, and interfering with the interaction between the jaw 304 and the striker bar 180.

Figure 23A:
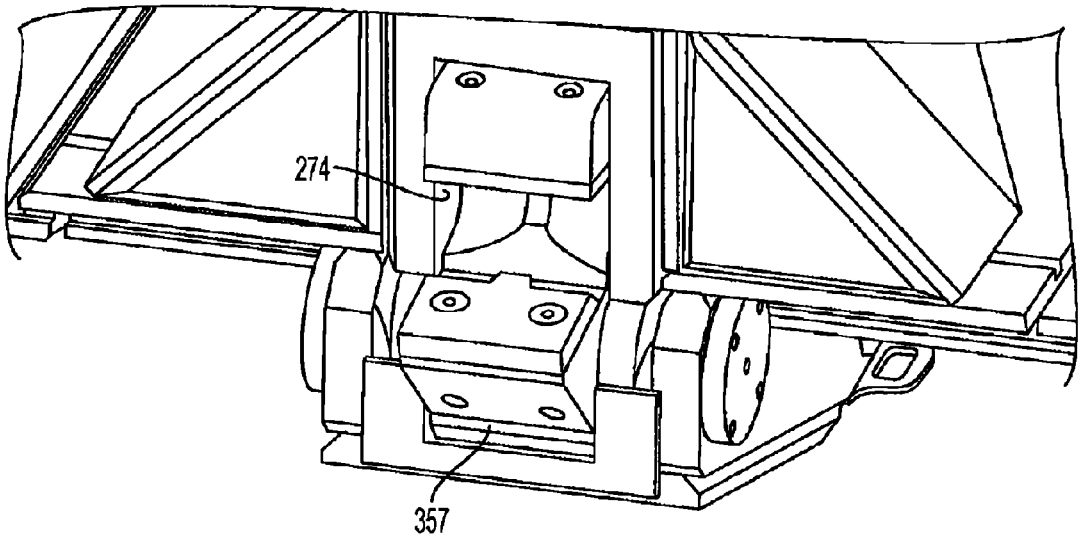
FIGS. 23A and 23*b* are perspective views of the jaw mounted in a jaw housing, with the jaw shown in its open and closed positions.
Figure 23B:
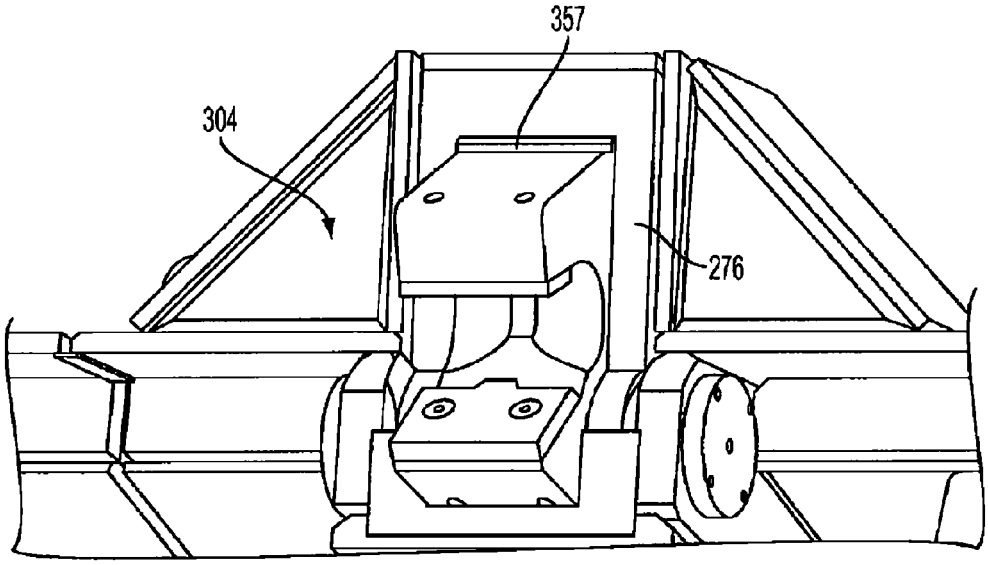

In another embodiment, as illustrated in FIGS. 23A and 23B, the jaw 304 is held within an opening 274 in a housing 276 closely adjacent to the jaw 304. Mounted on the jaw lip 108 and chin 112, on the radially outward outside surfaces, are wipers 357. The wipers 357 contact the jaw housing 276, and assist in the prevention of dirt coming into the jaw housing 276, and assist in removing any dirt that does come into the jaw housing 276.

Figure 24:
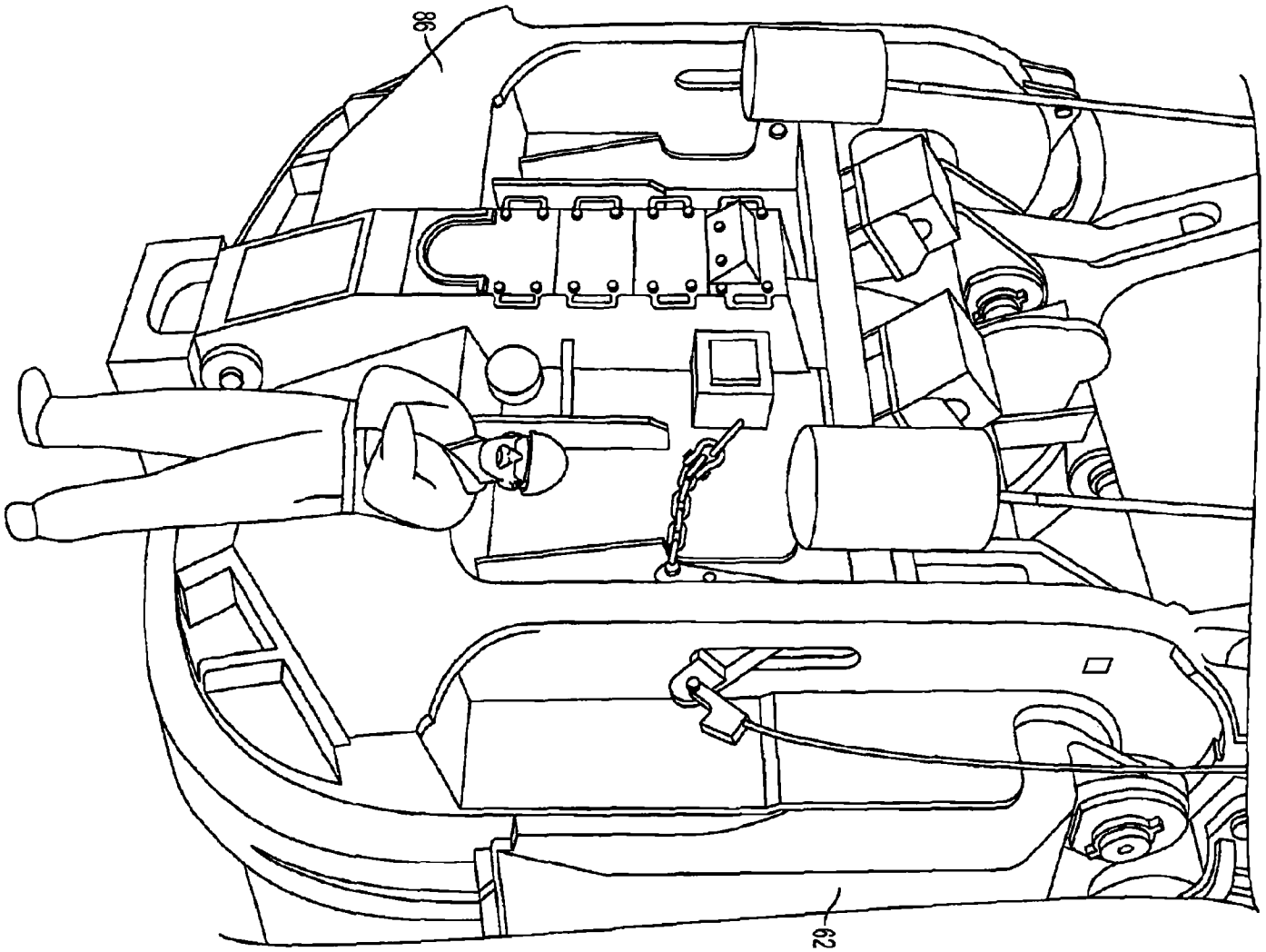
FIG. 24 is a perspective view illustrating the massive size of the dipper and dipper door relative to a person.

FIG. 24 illustrates the relative size and complexity of the dipper door 86 mounted on the dipper body 62, as compared to the size of a person. As is readily apparent, the latching of such a massive structure is substantially more complex than the latching of simpler doors. In one embodiment, a dipper carrying a load of 120 tons exerts a force of 186,553 lbs on the dipper striker bar 180. This force is controlled by a force of 8,165 lbs at the plunger 205. Therefore, the present invention provides a significant reduction in the force needed to control the door latch. In addition, the present invention replaces the dry, sliding friction load of 109,560 lbs on the latch with a lubricated friction load of 6,370 lbs. The present invention greatly reduces the accelerated wear associated with dry sliding friction.

Various features of the invention are set forth in the following claims.

What is claimed is:

1. A dipper adapted to be connected to a power shovel handle for movement therewith, said dipper comprising:

a dipper body defining an opening;

a dipper door mounted on said dipper body adjacent said opening, the door being pivotable relative to said dipper body between a closed position and an opened position; and a latch for releasable securing the door to the body to close the opening, the latch including a bar and a first member having a recess, the first member being pivotable between a locked position and an unlocked position, the latch releasable securing the door relative to the body when the first member is in the locked position and receives the bar within the recess, wherein when the door pivots to the door-closed position, the first member impacts the bar and the impact pivots said first member into the locked position.

2. A dipper in accordance with claim 1 wherein said bar is coupled to the dipper body and the first member is coupled to the dipper door.

3. A dipper in accordance with claim 1 wherein, when the door is in the open position, the first member is in the unlocked position, and, when the door is moved to the closed position, the bar engages the first member to move the first member to the locked position.

4. A dipper in accordance with claim 1 wherein said latch further includes a hold open mechanism for releasably holding said first member in said unlocked position when said door is in said open position, and a locking mechanism for releasably locking said first member relative to the bar when said first member is in said locked position.

5. A dipper in accordance with claim 4 wherein, when the locking mechanism is released, said first member rotates to the unlocked position as a result of the weight of the door and material pushing against the dipper door.

6. A dipper in accordance with claim 4 wherein said locking mechanism is a hydraulic cylinder assembly including a first end pivotally attached to said first member.

7. A dipper in accordance with claim 1 wherein the latch further includes a connecting link and a second member having a first end and a second end, the connecting link being pivotably coupled between the first member and the second member, the coupling of the second link and the connecting link forming a pivot joint.

8. A dipper in accordance with claim 7 wherein the latch further includes a resilient member coupled between the connecting link and the second member, the resilient member exerting a spring force on the connecting link and the second member to pivot the connecting link and the second member about the pivot joint.

9. A dipper in accordance with claim 8 wherein said pivot joint is movable across a line of action defined by the spring force exerted by the resilient member.

10. A dipper in accordance with claim 8 wherein said spring force biases the first member toward the unlocked position.

11. A dipper in accordance with claim 6 wherein said locking mechanism includes a closed loop hydraulic circuit in communication with said hydraulic cylinder assembly, said closed loop hydraulic circuit including at least one check valve, a locking valve and at least one accumulator.

12. A dipper in accordance with claim 11 wherein said locking valve is operable to be closed to prevent fluid flow through the hydraulic circuit and lock the locking mechanism.

13. A dipper in accordance with claim 11 wherein said locking mechanism is unlocked by opening said locking valve.

14. A dipper in accordance with claim 7 further comprising a secondary latch including an indentation receiving the second end of the second member, the secondary latch being pivotable between a release position and a hold position, the secondary latch releasably securing the second end of the second member within the indentation when the secondary latch is in the hold position, wherein securing the second end of the second member within the indentation retains the first member in the locked position.

15. A dipper in accordance with claim 14, wherein the secondary latch is biased toward the release position, and, wherein, when the secondary latch is in the hold position, the secondary latch is releasably secured by a plunger.

16. A dipper in accordance with claim 7, wherein the latch includes a bumper engageable with a portion of the second member to limit movement of the second member.

17. A dipper in accordance with claim 1, wherein the recess of the first member is C-shaped and defines an inner surface including a central portion and side portions on either side of the central portion, the side portions extending away from the central portion at an angle.

18. A dipper in accordance with claim 1, wherein the latch is positioned within a housing and the first member includes an outer surface, the outer surface including a wiper extending outwardly from the outer surface toward the housing to seal the housing against dirt.

19. A dipper for a mining machine, said dipper comprising:

a dipper body defining a material discharging opening;

a dipper door coupled to said dipper body adjacent said discharging opening for pivotal movement relative to said dipper body between a closed position and an opened position;

a first latch including a first bar, a first member having a recess for receiving the first bar, and a second member coupled to the first member, the first member being pivotable between a locked position and an unlocked position, the second member being pivotable between a locked position and an unlocked position, the second member including a second bar, wherein pivoting the second member from the locked position to the unlocked position causes the first member to pivot from the locked position to the unlocked position; and a second latch releasably holding said second member in said locked position when said first member is in said locked position.

20. A dipper in accordance with claim 19 wherein said second latch includes a bar holder having an indentation engaging the second bar.

21. A dipper in accordance with claim 19 wherein said first latch further includes a connecting link coupled between the first member and the second member and a spring attached between the second member and the connecting link, the coupling of the connecting link and the second member forming a pivot connection, the spring exerting a spring force on the connecting link and the second member to pivot the connecting link and the second member about the pivot connection.

22. A dipper in accordance with claim 21 wherein said pivot connection between the second member and the connecting link travels over a line of action defined by the spring force exerted by the spring.

23. A dipper in accordance with claim 21 wherein said spring biases the first member into the first member unlocked position.

24. A dipper in accordance with claim 19 wherein said second member is moved to the locked position by impact of the second bar against the indentation of the bar holder.

25. A dipper in accordance with claim 20 wherein said bar holder is pivotable between a release position and a hold position, said bar holder permitting movement of said second member to the unlocked position when the bar holder is in a release position.

26. A dipper in accordance with claim 25 wherein said bar holder is biased toward the release position and is releasable secured in the hold position by a plunger.

27. A dipper in accordance with claim 26 wherein said bar holder includes a cam surface having an end, and wherein the plunger presses against said cam surface and then slips into position when the end of the cam surface moves past the plunger, preventing movement of the bar holder.

28. A dipper in accordance with claim 27 wherein said plunger is biased toward secondary latch by a compression spring.

29. A dipper in accordance with claim 28 wherein the plunger is operable to be actuated remotely to release the bar holder from the hold position through an electronic signal.

30. A dipper in accordance with claim 19 wherein, when the bar holder releases the second bar, said first member rotates to the unlocked position as a result of the weight of the door and material pushing against the dipper door.

31. A dipper in accordance with claim 19 wherein said dipper body has a cutout adjacent said one end of said discharging opening, wherein the first bar is attached to said dipper body within said cutout, and wherein said first member impacts said first bar and rotates so that the first bar is received within the recess of the first member.

32. A dipper in accordance with claim 31 wherein said first bar is rotatable relative to said dipper body.

33. A dipper in accordance with claim 19 wherein, when the door is in the open position, the first member is in the unlocked position, and, when the door is moved to the closed position, the first member pivots to the locked position and receives the first bar within the recess, thereby releasably securing the door against the body.

34. A dipper in accordance with claim 19 wherein said dipper door includes two spaced apart structural support ribs, and wherein the first latch and the second latch are pivotably mounted between said support ribs.

35. A dipper in accordance with claim 19 wherein said latch further includes a first bumper stop adjacent one side of the pivotal connection of the second member and the connecting link, and a second bumper stop adjacent to the other side of the pivotal connection of the second member and the connecting link.

36. A dipper in accordance with claim 19 wherein said first member is "C" shaped and the recess is defined by a mouth having a width, and wherein said mouth has a central engaging surface narrower than said mouth width, and outer surfaces that angle away from said central engaging surface.

37. A dipper in accordance with claim 19 wherein said first latch is mounted within a housing, and wherein said first member includes an outer surface having wipers extending between said jaw outer surface and said housing.

38. A dipper for a mining machine, the dipper comprising:

a body including an opening;

a door coupled to the body to selectively open and close the opening, the door being pivotable between an open position and a closed position;

a latch mechanism for releasably securing the dipper door in the closed position, the latch mechanism including a bar and a latch for engaging the bar, the latch being moveable between a locked state and an unlocked state;

a plunger moveable between a first position and a second position, such that, when the plunger is in the first position, the latch mechanism is biased toward the unlocked state and, when the plunger is in the second position, the latch mechanism is permitted to move toward the locked state; and a drive mechanism coupled to the plunger, the drive mechanism moving the plunger from the first position to the second position when the dipper door is near the closed position.

39. The dipper of claim 38, further comprising a biasing member for biasing the plunger toward the first position.

40. The dipper of claim 38, wherein the latch mechanism includes a jaw having a recess for receiving the bar, the bar being positioned in the recess in the locked state.

41. The dipper of claim 40, wherein the latch mechanism further includes a second member coupled to the jaw and a bar holder, the second member being pivotable between a locked position and an unlocked position, wherein pivoting the second member from the locked position to the unlocked position causes the jaw to pivot to a position to receive the bar, the bar holder releasably securing the second member in the locked position, and wherein, when the plunger is in the first position, the plunger biases the bar holder away from securing the second member.

42. The dipper of claim 38, wherein the drive mechanism includes a chain, wherein, when the door is substantially near the closed position, the chain pulls the plunger from the first position to the second position to allow the latch to move toward the locked position.

43. The dipper of claim 38, wherein the drive mechanism includes a pivoting extractor, the extractor having a first end coupled to the plunger and a second end.

44. The dipper of claim 43, wherein the plunger and the drive mechanism are coupled to the door such that, when the door is substantially near the closed position, the second end of the extractor engages the body and causes the extractor to pivot, pulling the plunger from the first position to the second position to allow the latch to move toward the closed position.

45. The dipper of claim 44, wherein the drive mechanism further includes a roller rotatably coupled to the second end of the extractor and adapted to engage the body as the door approaches the closed position.

* * * * *